United States Patent [19]

Yamamoto

[11] Patent Number: 4,944,156

[45] Date of Patent: Jul. 31, 1990

[54] AIR CONDITIONING SYSTEM INTO WHICH A REFRIGERATOR OR A WARMING CABINET IS INTEGRATED, AND POWER SOURCE CIRCUIT THEREFOR

[75] Inventor: Katsuharu Yamamoto, Shizuoka, Japan

[73] Assignee: Mitsubishi Denki Kabushiki Kaisha, Tokyo, Japan

[21] Appl. No.: 288,273

[22] Filed: Dec. 22, 1988

[30] Foreign Application Priority Data

Dec. 23, 1987 [JP] Japan ..... 62-325751
Aug. 3, 1988 [JP] Japan ..... 63-193078

[51] Int. Cl.[5] ..... F25B 27/00

[52] U.S. Cl. ..... 62/324.6; 62/510; 62/160

[58] Field of Search ..... 62/524, 510, 498, 115, 62/324.6, 160

[56] References Cited

U.S. PATENT DOCUMENTS 1,909,893 5/1933 Potter ..... 62/524 X
3,184,926 5/1965 Blake ..... 62/510 X
4,545,215 10/1985 Inoue ..... 62/498 X
4,748,820 6/1988 Shaw ..... 62/510 X

*Primary Examiner*—William E. Wayner

*Attorney, Agent, or Firm*—Oblon, Spivak, McClelland, Maier & Neustadt

[57] ABSTRACT

An air conditioning system with a refrigerator integrated, includes (a) an air conditioning device having a first cycle comprising (i) a compressor for compressing a refrigerant to turn it into the gaseous refrigerant having high temperature and high pressure, (ii) a condenser for cooling the gaseous refrigerant to turn it into the liquid refrigerant having middle temperature and high pressure, (iii) a first expansion valve for giving adiabatic expansion to the liquid refrigerant to turn it into the vaporous liquid refrigerant having low temperature and low pressure, and (iv) a first evaporator for evaporating the vaporous liquid refrigerant to turn it into the gaseous refrigerant, and for returning the gaseous refrigerant to the compressor, and (b) the refrigerator having a second cycle comprising (i) the compressor, (ii) the condenser, (iii) a second expansion valve for giving adiabatic expansion to the liquid refrigerant received from the condenser thereby to turn it into the vaporous liquid refrigerant having low temperature and low pressure, and (iv) a second evaporator for evaporating the vaporous liquid refirgerant received from the second expansion valve thereby to turn it into the gaseous refrigerant having low temperature and low pressure, and for returning the gaseous refrigerant to the compressor.

9 Claims, 19 Drawing Sheets

FIGURE 17 (CIRCUIT ON ROOM-HEATING)
PRIOR ART
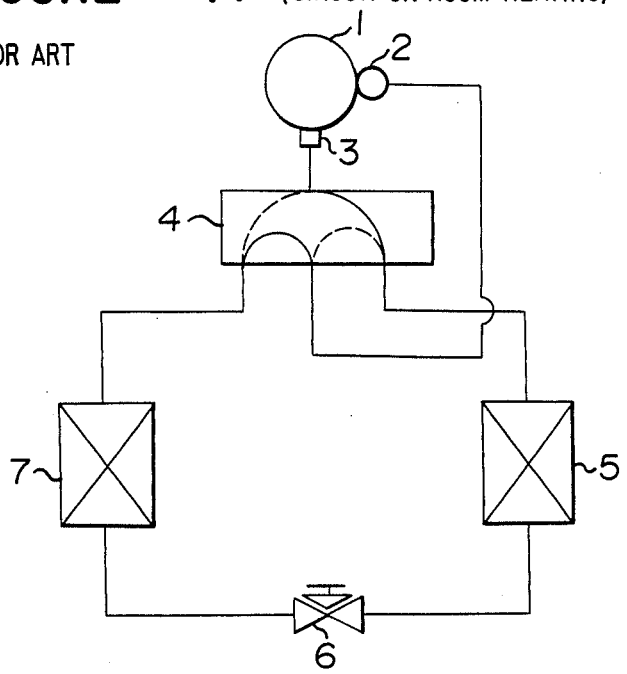
FIGURE 18 (CIRCUIT ON ROOM-COOLING)
PRIOR ART
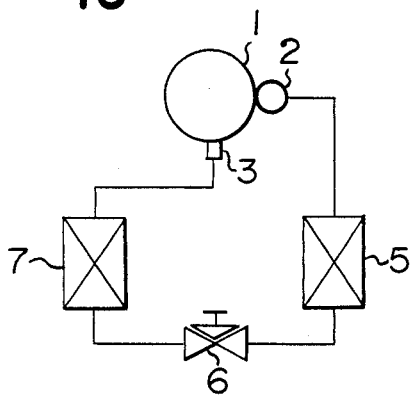

AIR CONDITIONING SYSTEM INTO WHICH A REFRIGERATOR OR A WARMING CABINET IS INTEGRATED, AND POWER SOURCE CIRCUIT THEREFOR

FIELD OF THE INVENTION

The present invention relates to an air conditioning system into the refrigeration system of which a refrigerator or a warming cabinet is incorporated so as to use a common refrigerant.

BACKGROUND OF THE INVENTION

FIG. 17 is a circuit diagram showing the operation a conventional heat pump type of room cooling and heating device (hereafter referred to as an air conditioner) at the time of room heating, as disclosed in, e.g., Japanese Unexamined Utility Model Publication No. 42335/1982. In FIG. 17, reference numeral 1 designates a closed type of compressor for the air conditioner. Reference numeral 2 designates an intake tube for the compressor 1. Reference numeral 3 designates a discharge tube for the compressor 1. Reference numeral 4 designates a four port valve which switches the flowing direction of the gaseous refrigerant discharged from the discharge tube 3. At the time of room heating, the gaseous refrigerant having high temperature is led to an indoor heat exchanger 5 through the four port valve 4, is led to an outdoor heat exchanger 7 through an expansion valve 6, and is returned to the intake tube 2 for the compressor 1 through the four port valve 4. FIG. 17 is the circuit diagram showing the switching position which the four port valve 4 takes at the time of room-heating, while FIG. 18 a basic circuit diagram on room-cooling wherein the four port valve 4 is omitted in order to make the operation of the circuit easily understandable.

By the way, a conventional domestic refrigerator has on the back a structure as shown in FIG. 19. A conventional three door type of refrigerator has a structure as shown in FIG. 21 in a vertical section.

In FIGS. 19 and 21, reference numeral 8 designates a refrigerator cabinet. Reference numeral 9 designates a machine compartment. Reference numeral 10 designates a compressor. Reference numeral 11 designates a condensor. Reference numeral 13 designates an evaporator. Reference numeral 87 designates a subcondenser for drain evaporation. Reference numeral 90 designates a drain pan. Reference numeral 91 designates a freezing compartment. Reference numeral 92 designates a refrigerating compartment. Reference numeral 93 designates a vegetable compartment. Reference numeral 94 designates a low pressure refrigerant pipe. Reference numerals 95 designate doors for the refrigerator.

The refrigerator cabinet 8 includes the machine compartment 9 to house the compressor 10 in it, and it has its rear surface provided with a meander form of condenser 11. The refrigerating circuit for the domestic refrigerator is shown in FIG. 20 wherein reference numeral 12 designates a capillary tube. It is understandable that the refrigerating circuit for the domestic refrigerator has the same constituent elements as the cooling circuit of the air conditioner at room cooling as shown in FIG. 18.

The operations of the air conditioner and the refrigerator will be explained. Since the operation of the refrigerator is the same as that of the air conditioner at room cooling, the explanation will be made in reference to FIG. 18. Now, the operation of the air conditioner at room cooling will be explained.

Domestic air conditioners usually use Freon 22 (hereafter referred to as R-22) as the refrigerant. In FIG. 18, the refrigerant which is discharged from the discharging tube 3 of the compressor 1 in the form of gas having high temperature and high pressure is led to the outdoor heat exchanger 7 where the gas is liquefied while being cooled. The liquefied R-22 is given adiabatic expansion by the expansion valve 6, and it is led to the indoor heat exchanger 5 where the liquefied R-22 absorbs heat energy from the air in the room and becomes a gaseous form. After that, the refrigerant R-22 is returned to the intake tube 2 of the compressor 1.

At the time of room heating, the four port valve 4 switches the flow direction of the refrigerant as shown in FIG. 17 so that the indoor heat exchanger 5 comes into a higher temperature state and the outdoor heat exchanger 7 comes into a lower temperature state to carry out room heating.

On the other hand, domestic refrigerators usually use Freon 12 (hereafter referred to as R-12) as the refrigerant. Since, unlike air conditioners refrigerators do not require a heating function, the four port valve 4 as shown in FIG. 17 is not needed. Because in refrigerators the heat exchangers do not come into different temperature states depending on cooling or heating operation (unlike air conditioners), one of the exchangers is constantly called a condenser and the other is called an evaporator. As stated above, the operation of refrigerators is the same as that of the air conditioners on cooling as explained in reference to FIG. 17.

Although conventional domestic air conditioners have room cooling and room heating functions, the air conditioners are driven in limited periods in one year. Even when they are driven, they are not always driven all day long, and, for example, they are not usually driven at night. With the conventional air conditioners, there is a problem with small operating efficiency.

On the other hand, conventional domestic refrigerators use the refrigerant R-12, which is different from the refrigerant R-22 usually used in domestic air conditioners. R-12 is suitable as the refrigerant for domestic refrigerators because it has a small compression ratio between a high pressure gas and a low pressure gas, and a longer life can be realized in refrigerators having such limited volume that they become popular for domestic use in the market. Using in domestic refrigerators a refrigerant which is different from the one of domestic air conditioners having the same cooling operational principle creates a problem wherein manufactures of domestic refrigerators and domestic air conditioners must have charging stands for different refrigerants, separately. The use of R-12 should be avoided in terms of a problem wherein decomposed R-12 decreases ozone outside the atmosphere, which is now topical throughout the world. In addition, there is also a problem wherein the provisions of the condenser 11 on the rear surface of the refrigerator and of the compressor 10 in the machine compartment 9 as shown in FIG. 19 make the inner volume of the refrigerator small.

Domestic refrigerators have a disadvantage in that most of them are placed in rooms such, as is kitchens as well known, and noise from the compressor gives discomfort to users.

Domestic refrigerators also have a disadvantage in that heat radiated from the condenser 11 increases the temperature in the room.

Recent domestic refrigerators are large-sized, and a variety of foods are housed in the refrigerators. It is said that food to be frozen had better be frozen as rapidly as possible in terms of freshness and good taste of the food as thawed for cooking. For that reason, domestic refrigerators are designed by the manufacturers to make the evaporation temperature in the evaporator 13 as low as possible. If the temperature of the evaporator 13 is lower (generally below −40° C.), moisture in the air is condensed on the outer surface of the low pressure refrigerant pipe 94 (the tube exposed outside the refrigerators between the outlet of the evaporator 13 and the compressor 10) which is exposed in the machine compartment 9 in the rear portion of the refrigerators as shown in FIGS. 19 and 21. The condensed moisture creates frost-forming phenomenon. Because the conventional domestic refrigerators have a structure wherein the compressor 10 is housed in the machine compartment 9, it is difficult to arrange below the low pressure refrigerant pipe 94 and the compressor 10 a drain pan for reserving drainage which is produced by melting after the frost-forming phenomenon.

As a result, it is necessary with conventional refrigerators that the evaporation temperature in the evaporator 13 be above −40° C. to avoid the frost-forming phenomenon even though the rapid freezing is desired.

It is an object of the present invention to dissolve such problems, and to provide an air conditioning system with a refrigerator integrated, wherein an air conditioning device and the refrigerator are operated by use of a common refrigerant, operating efficiency of the air conditioning device is improved, the compressor installed in the machine compartment of the refrigerator is replaced by an outdoor compressor of the air conditioning device, and the condenser normally provided on the rear surface of the refrigerator is replaced by a higher temperature of heat exchanger of the air conditioning device (it means the heat exchanger functions as a condenser i.e., an outdoor heat exchanger on cooling and an indoor heat exchanger on heating).

SUMMARY OF THE INVENTION

The foregoing and the other objects of the present invention have been attained by providing an air conditioning system with a refrigerator integrated, wherein the compressor used for an air conditioning device (hereafter referred to as air conditioner) and installed outside the room is commonly used for the refrigerator as well, a higher temperature of heat exchanger used for the air conditioner and functioning as a condenser inside or outside the room is commonly used for the refrigerator as well, and refrigerant used in the air conditioner is commonly used for the refrigerator as well.

The present invention also provides an air conditioning system with a refrigerator integrated, including: a refrigerant circuit comprising a compressor, a four port valve, an outdoor heat exchanger, a decompression device, and an indoor heat exchanger; a switching circuit having its input end connected to the outdoor heat exchanger and the indoor heat exchanger, and having its output end connected to the decompression device; air conditioning elements comprising the four port valve, the indoor heat exchanger and the decompression device, and; refrigerator elements which are arranged in parallel with the air conditioning elements, and comprise a capillary tube and an evaporator; wherein at the time of food-refrigerating and room-cooling operation, a refrigerant is compressed by the compressor, the compressed refrigerant is condensed in the outdoor heat exchanger, the condensed refrigerant is divided in parts for the air conditioning elements and for the refrigerator elements to be evaporated in the respective routes, and the evaporated parts from the respective routes are joined and returned to the compressor, and; wherein at the time of food-refrigerating and room-heating operation, the refrigerant is compressed by the compressor, the compressed refrigerant is condensed in the indoor heat exchanger, the condensed refrigerant is divided in parts for the refrigerator elements and for the decompression device, the part decompressed in the decompression device is evaporated in the outdoor heat exchanger, and the part evaporated in the outdoor heat exchanger is joined with the part evaporated in the refrigerator route and returned to the compressor.

The present invention also provides an air conditioning system in which a warming cabinet is integrated, including: a refrigerant circuit comprising a compressor, a four port valve, an outdoor heat exchanger, a decompression device, and an indoor heat exchanger; a switching circuit having its input end connected to the outdoor heat exchanger and the indoor heat exchanger, and having its output end connected to the decompression device; and a radiator for the warming cabinet; wherein at the time of warming and room cooling operation, a refrigerant is compressed by the compressor, the compressed refrigerant discharged from the compressor is divided in parts for a circuit which comprises the four port valve and the outdoor heat exchanger in the refrigerating circuit and has higher pressure at the room cooling operation, and for the radiator, the parts are condensed in each route, the condensed parts are joined, the joined one is passed through the decompression device, the indoor heat exchanger and the four port valve in this order, and the joined one is returned to the compressor; and wherein at the time of warming and room-heating operation, the refrigerant is compressed by the compressor, the compressed refrigerant discharged from the compressor is divided in parts for a circuit which comprises the four port valve and the indoor heat exchanger in the refrigerant circuit and has higher pressure at the time of room-heating operation, and for the radiator, the divided parts are condensed in each route, the divided parts are joined, the joined one is passed through the decompression device, the outdoor heat exchanger and the four port valve in this order, and it is returned to the compressor.

In accordance with the present invention, pressure adjusting means included in the compressor and the refrigerator elements can share a rectification circuit for inverter drive.

BRIEF DESCRIPTION OF THE DRAWINGS

FIGS. 10 through 15 are structural diagrams showing further embodiments using a check valve bridge, wherein FIG. 10 shows a seventh embodiment, FIGS. 11 through 13 show eighth through tenth embodiments, FIG. 14 shows an eleventh embodiment, and FIG. 15 shows twelfth embodiment;

FIG. 17 is the circuit diagram in the conventional air conditioner;

FIG. 18 is the circuit diagram of FIG. 17 on cooling;

DETAILED DESCRIPTION OF THE PRESENTLY PREFERRED EMBODIMENTS

Now, the present invention will be described in detail with reference to preferred embodiments illustrated in the accompanying drawings.

The First Embodiment

A first embodiment of the present invention will be explained.

Figure 1:
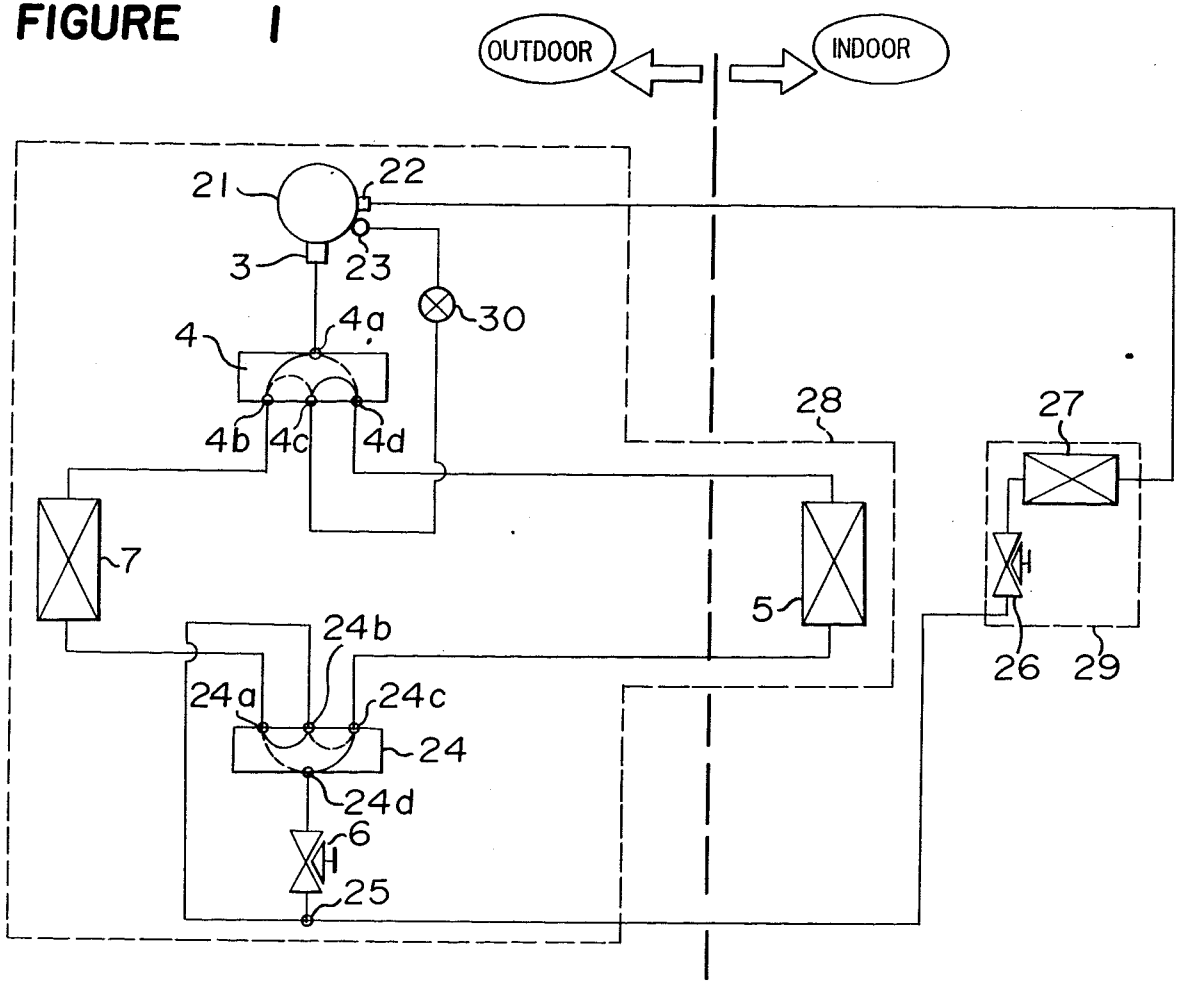
FIG. 1 is a structural diagram showing a basic cycle of the air conditioning system according to a first embodiment of the present invention.

FIG. 1 shows the basic cycle of an air conditioning system with a refrigerator 29 integrated according to a first embodiment. In the system, an air conditioning device 28 is in room cooling operation cycle, i.e. cooling cycle. The refrigerant as used in the cycle is R-22.

The air conditioning device 28 for room cooling and room heating is constituted by a compressor 21, an outdoor heat exchanger 7, an electronic expansion valve 6, and an indoor heat exchanger 5. On the other hand, the refrigerator 29 is constituted by the compressor 21, the outdoor heat exchanger 7, an electronic expansion valve 26, and an evaporator 27.

The air conditioning device 28 also includes a first four port valve 4 and a second four port valve 24. The compressor 21 is an enclosed type of rotary compressor which has a first intake tube 22, a second intake tube 23, and a discharge tube 3. The discharge tube 3 is connected to a connecting port 4*a* of the first four port valve 4. The outdoor heat exchanger 7 has one end connected to a connecting port 4*b* of the first four port valve 4, and the other end connected to a connecting port 24*a* of the second four port valve 24 as a switching circuit. The air conditioning device also includes a T-pipe joint 25, the first connecting port of which is connected to a connecting port 24*b* of the second four port valve 24, the second connecting port of which is connected to the electronic expansion valve 6 for the air conditioning device, and the third connecting port of which is connected to the electronic expansion valve 26 for the refrigerator. The electronic expansion valve 6 has the end remote from the T-pipe joint connected to a connecting port 24*d* of the second four port valve 24. The indoor heat exchanger 5 of the air conditioning device has one end connected to a connecting port 4*d* of the first four port valve 4 and the other end connected to a connecting port 24*c* of the second four port valve 24. The second intake tube 23 of the compressor 21 is connected to a connecting port 4*c* of the first four port valve 4 through a solenoid controlled valve 30. On the other hand, the evaporator 27 in the refrigerator has one end connected to the first intake tube 22 of the compressor 21 and the other end connected to the electronic expansion valve 26. In this way, the refrigerating cycle of the refrigerator 29 is incorporated in the cooling and heating cycle of the air conditioning device 28.

Figure 2:
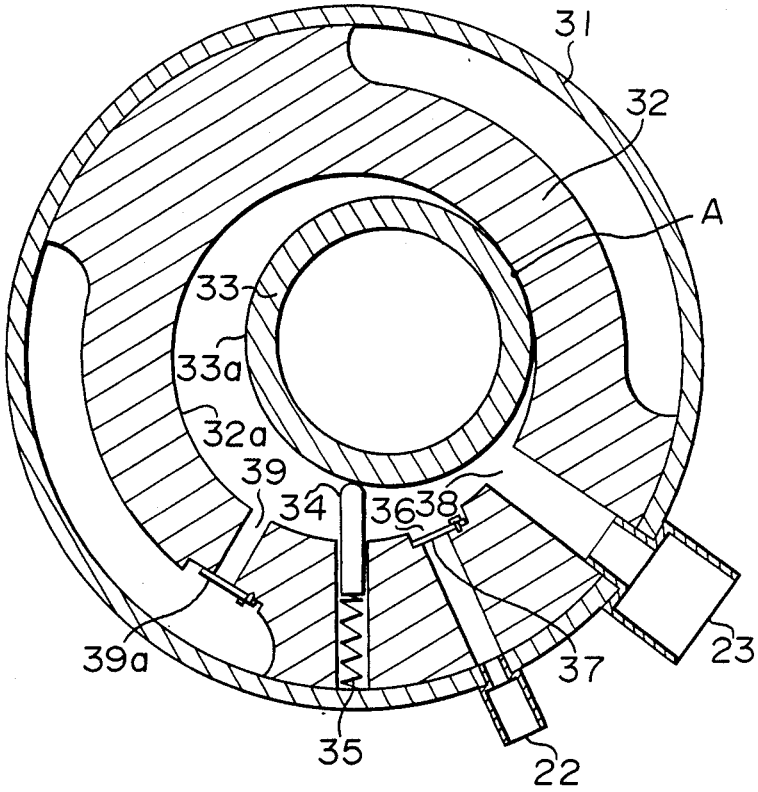
FIG. 2 is a transverse cross section showing a compressor employed in the cycle as shown in FIG. 1.

FIG. 2 shows a transverse cross section of the rotary compressor 21. The compressor 21 is produced by forming two intake ports (i.e., a first intake port 36 and a second intake port) in a cylinder 32 of the enclosed type of rotary compressor which has been widely used in conventional refrigerators and conventional air conditioning devices. The intake ports 36 and 38 are formed in the cylinder 32 at positions ahead of the vane 34 in the direction of rotation of a rolling piston 33 in the conventional enclosed type of rotary compressor. The first intake port 36 which is closer to the vane 34, includes an intake valve 37. The first intake port 36 and the second intake port 38 correspond to the first intake tube 22 and the second intake tube 23, respectively.

In FIG. 2, reference numeral 31 designates a compressor shell, reference numeral 32*a* designates the inner circumferential surface of the cylinder 32, reference numeral 33*a* designates the outer circumferential surface of the rolling piston 33, and reference numeral 35 designates a vane spring. Reference numeral 39 designates a discharge port 39, reference numeral 39*a* designates a valve for the discharge port, and reference A designates a contacting point between the cylinder 32 and the rolling piston 33.

The operation of the system on cooling will be explained.

The gaseous R-22 having high temperature and high pressure which has been compressed in the compressor 21 and discharged from the discharge tube 3 is led through the first four port valve 4 to the outdoor heat exchanger (condenser) 7, where it is condensed to be liquefied. The liquefied R-22 having middle temperature and high pressure is led through the second four port valve 24 to the electronic expansion valve 6 and to the electronic expansion valve 26, respectively. The liquid R-22 led to the electronic expansion valve 6 is given adiabatic expansion to become a vaporous form, and the R-22 is evaporated in the indoor heat exchanger (evaporator) 5 to cool the inside of the room with heat of vaporization caused at the time. The refrigerant R-22 which has thus become in a gaseous form having low temperature and low pressure is returned to the compressor 21 through the first four port valve 4.

On the other hand, the liquid refrigerant R-22 led to the electronic expansion valve 26 is given adiabatic expansion in there to become a vaporous form, and the vaporous R-22 is evaporated in the cooling device (evaporator) 27 to cool the inside of the refrigerator with heat of vaporization. The refrigerant which has thus become a gaseous form having low temperature and low pressure is returned to the compressor 21.

The operation of the system on room heating will be explained. On room heating, the first and the second four port valve 4 and 24 are switched from the positions indicated in the solid lines to the positions indicated in the dotted lines to form a room heating cycle for the air conditioning device 28. At that time, the indoor heat exchanger 5 functions as a condenser, and the outdoor heat exchanger 7 functions as an evaporator.

When the air conditioning device 28 is not in use, the electronic expansion valve 6 and the solenoid controlled valve 30 are closed to form a cooling cycle exclusively for the refrigerator 27.

Figure 3:
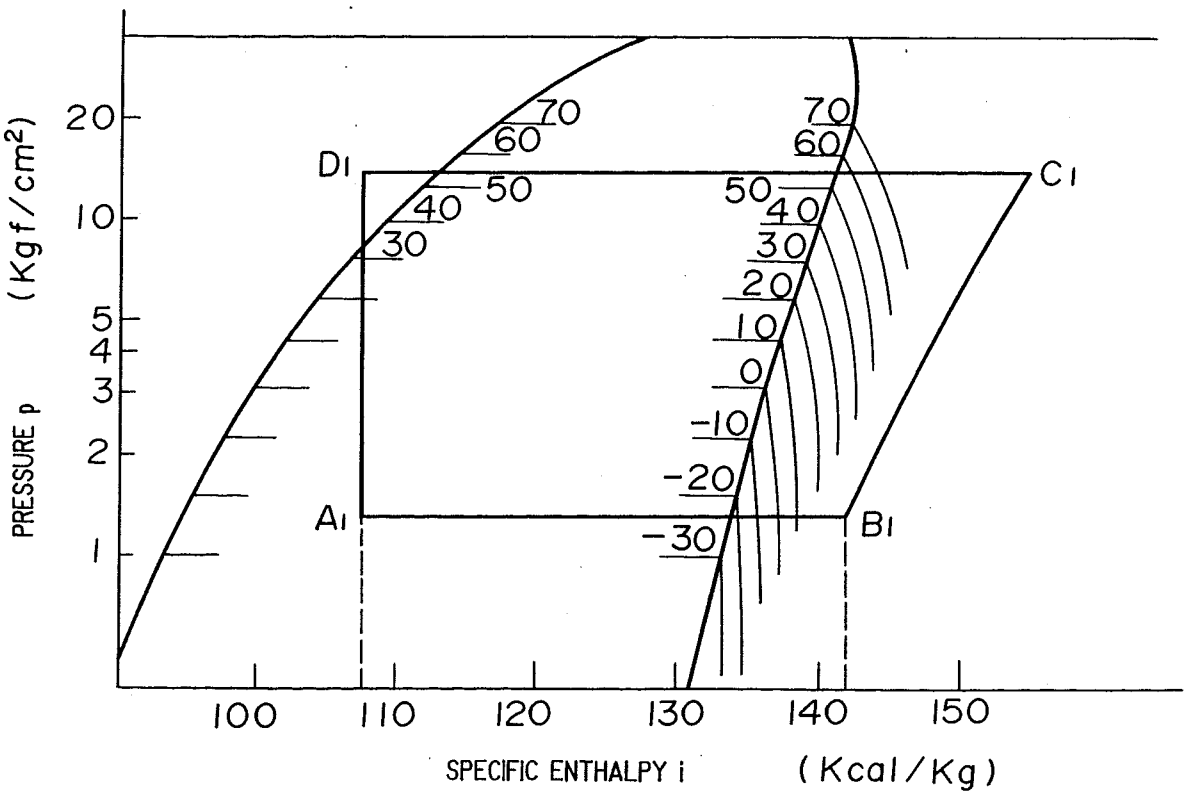
FIG. 3 is a pressure-enthalpy diagram of the refrigerant R-12 used in the conventional domestic refrigerators.
Figure 4:
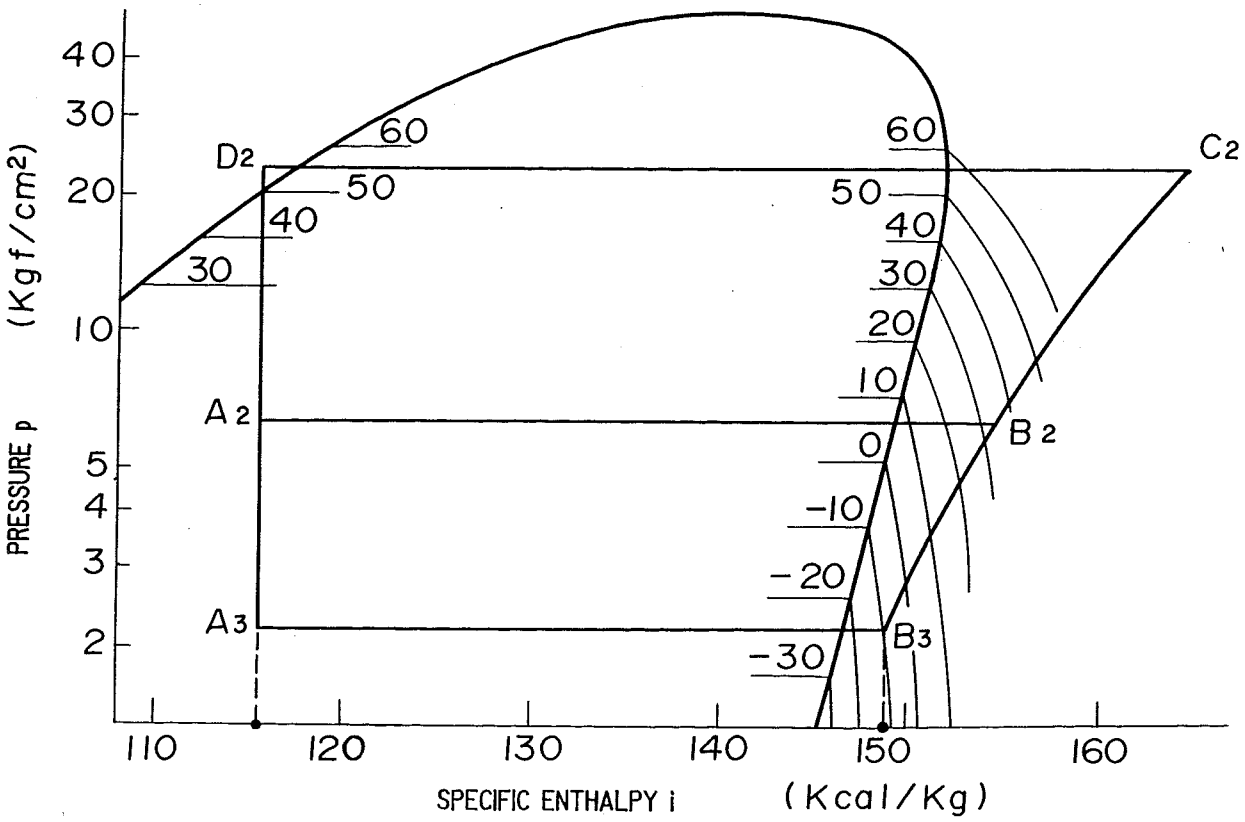
FIG. 4 is a pressure-enthalpy diagram of the refrigerant R-22 used in the first embodiment.

Now, it will be explained in reference to the pressure-enthalpy diagram of the refrigerant as shown in FIGS. 3 and 4 how the refrigeration cycle of the refrigerator 29 and the room cooling cycle of the air conditioning device 28 can be realized by sharing the compressor, the condenser, and the refrigerant.

The standard operation conditions of the refrigeration cycle in the refrigerators which are domestically used at the present time and in which the refrigerant R-12 is utilized are as follows:

condensation temperature: 54.4° C., evaporation temperature: −23.2° C., temperature before expansion valve: 32.2° C., intake gas temperature: 32° C.

FIG. 3 is a pressure-enthalpy diagram of the refrigerant R-12 showing the refrigerating cycle in the conventional domestic refrigerators.

In FIG. 3, the specific enthalpy at a point $A_1$ and that at a point $B_1$ are as follows:

$$i_{A1} \approx 108 \text{ Kcal/Kg}, \; i_{B1} \approx 142 \text{ Kcal/Kg}$$

If the reference between the specific enthalpy at the point $B_1$ and that at the point $A_1$ is represented by $\Delta i_1$, the following equation is obtained:

$$\Delta i_1 = i_{B1} - i_{A1} = 34 \text{ Kcal/Kg} \quad (1)$$

The volumetric efficiency and pump displacement of the compressor for the refrigerators using the refrigerant R-12 are represented by $\eta_1$ and $W_1$ (Kg/hr), respectively, the cooling capacity $Q_1$ of refrigerators is indicated as follows:

$$Q_1 = \eta \cdot W_1 \Delta i_1 \quad (2)$$

On the other hand, the standard operation conditions of the cooling cycle in the domestic air conditioners which carry out room cooling by use of the refrigerant R-22 are as follows:

condensation temperature: 54.4° C., evaporation temperature: 7.2° C., temperature before expansion valve: 46.1° C., intake gas temperature: 35° C.

FIG. 4 is a pressure-enthalpy diagram of the refrigerant R-22 showing the cooling cycle in the domestic air conditioners. When the adiabatic expansion process between a point $C_2$ and a point $A_2$ in FIG. 4 is further continued, the evaporation temperature which is equal to the evaporation temperature (−23.2° C.) between the evaporation process $A_1B_1$ as shown in FIG. 3 is obtained at a point $A_3$ in FIG. 4.

If the intersection of an isothermal line in the adiabatic compression process between a point $B_2$ and the point $C_2$, and a straight line passing through the point $A_3$ and in parallel with the abscissa axis in FIG. 4 is called a point $B_3$, the evaporation process $A_3B_3$ will have an evaporation temperature of −23.3° C. which is equal to the evaporation process $A_1B_1$ as shown in FIG. 3. If the specific enthalpy at the point $A_3$ and the one at the point $B_3$ are represented with $i_{A3}$ and $i_{B3}$, respectively, the following equations are obtained:

$$i_{A3} \approx 115 \text{ (Kcal/Kg)}, \; i_{B3} \approx 149 \text{ (Kcal/Kg)}$$

If the difference between the specific enthalpy at the point $B_3$ and the one at the point $A_3$ is represented by $\Delta i_3$, the following equation is obtained:

$$\Delta i_3 = i_{B3} - i_{A3} = 34 \text{ (Kcal/Kg)} \quad (3)$$

If the volumetric efficiency and the pump displacement of the refrigerant (R-22) of a compressor which can embody the cooling cycle $A_3$, $B_3$, $C_2$ and $D_2$ are represented with $\eta_3$ and $W_3$ (Kg/hr), respectively, the cooling capacity $Q_3$ of the cooling cycle $A_3$, $B_3$, $C_2$ and $D_2$ is as follows:

$$Q_3 = \eta_3 \cdot W_3 \cdot \Delta i_3 \quad (4)$$

Because the equation (1) and the equation (3) indicate $\Delta i_1 = \Delta i_3$ (=34 Kcal/Kg), the comparison of the cooling capacity $Q_1$ of the conventional refrigerators using R-12 and the cooling capacity $Q_3$ of the cooling cycle $A_3$, $B_3$, $C_2$ and $D_2$ in the first embodiment reveals that the following equation must be satisfied in order to hold the equation $Q_1 = Q_3$:

$$\eta_1 W_1 = \eta_3 W_3 \quad (5)$$

If a compressor wherein the equation $\eta_1 = \eta_3$ holds can be embodied, it is possible to hold the equation $Q_3 = Q_1$ because the pump displacement $W_3$ of the refrigerant R-22 becomes the pump displacement $W_1$ of the refrigerant R-12.

The most standard cooling capacity $Q_2$ of the conventional air conditioners and the most standard cooling capacity $Q_3$ of the conventional refrigerators are considered to be 2400 Kcal/hr and 200 Kcal/hr, respectively. Namely, $Q_2 = 2400$ Kcal/hr and $Q_3 = 200$ Kcal/hr hold.

If pump displacement of the cooling cycle $A_2$, $B_2$, $C_2$ and $D_2$ of the air conditioning device as shown in FIG. 4 is represented with $W_2$, and if the specific enthalpy at the point $A_2$ and the one at the point $B_2$ are represented with $i_{A2}$ and $i_{B2}$, respectively, the following equations are obtained:

$$\Delta i_2 = i_{B2} = i_{A2} \approx 155 - 115 = 40 \text{ Kcal/Kg}$$

$$W_2 = Q_2/(\eta_2 \cdot \Delta i_2) \approx \frac{1}{\eta_2} \; \frac{2400}{40} = \frac{60}{\eta_2} \text{ and}$$

$$W_3 = Q_3/(\eta_3 \cdot \Delta i_3) \approx \frac{1}{\eta_3} \; \frac{200}{34} = \frac{6}{\eta_3}$$

If $\eta_2 = \eta_3$ holds, the required pump displacement ratio of the cooling cycle $A_2$, $B_2$, $C_2$ and $D_2$ ($Q_2 = 2400$ Kcal/hr) and the refrigerating cycle $A_3$, $B_3$, $C_2$ and $D_2$ ($Q_3 = 200$ Kcal/hr) is as follows:

$$W_2 : W_3 = 60 : 6 = 10 : 1 \quad (6)$$

For example, the relationship indicated in the equation (6) which can be determined based on these cooling capacities is one of the design factors which are required for determining the relative positions between the first intake port 36 and the second intake port 38 as shown in FIG. 2.

A comparison of the cooling cycle $A_2$, $B_2$, $C_2$ and $D_2$ (the room cooling cycle of the air conditioning device 28) and the cooling cycle $A_3$, $B_3$, $C_2$ and $D_2$ (the refrigerating cycle of the refrigerator 29) as shown in FIG. 4 to the basic cycle as shown in FIG. 1 reveals the following correspondence:

$A_2B_2$: Process wherein the refrigerant evaporates in the indoor heat exchanger 5

$B_2C_2$: Process wherein the refrigerant inspired through the second intake tube 23 is compressed by the compressor 21

$C_2D_2$: Process wherein the refrigerant is condensed in the outdoor heat exchanger 7

$D_2A_2$: Process wherein the refrigerant is given adiabatic expansion by the electronic expansion valve 6

$A_3B_3$: Process wherein the refrigerant evaporates in the evaporator 27 of the refrigerator $B_3C_2$: Process wherein the refrigerant inspired through the first intake tube 22 is compressed by the compressor 21

$C_2D_2$: Process wherein the refrigerant is condensed in the outdoor heat exchanger 7

$D_2A_3$: Process wherein the refrigerant is given adiabatic expansion by the electronic expansion valve 26

This indicates that the air conditioning device 28 and the refrigerator 29 share the compressor and the condensor to realize the cooling cycle for the former and the refrigerating cycle for the latter.

The refrigerant flow rates required for the respective cooling and refrigeration cycles are adjusted by the electronic expansion valves 6 and 26, and the compressor 21. The electronic expansion valves 6 and 26 can be controlled based on the information on the evaporation temperatures at, e.g., the indoor heat exchanger 5 and the evaporator 27.

Adjusting the refrigerant flow rates by the compressor 21 is made as follows: when the contacting point A between the outer circumferential surface 33*a* of the rolling piston 33 and the inner circumferential surface 32*a* of the cylinder 32 passes the vane 34 and reaches the first intake port 36 in FIG. 2, the area in the cylinder surrounded by the vane 34, the inner circumferential surface 32*a* of the cylinder 32, the outer circumferential surface 33*a* of the rolling piston 33, and the contacting point A has in it a pressure lower than the pressure of the intake gas inspired through the first intake tube 22. As a result, the intake valve 37 is opened to allow the refrigerant to enter from the first intake tube 22 through the first intake port 36. The pressure $P_{B3}$ in the first intake port 36 at that time is the pressure at the point $B_3$ in the refrigerating cycle $A_3$, $B_3$, $C_2$ and D of the refrigerator as shown in FIG. 4, i.e. $P_{B3} \approx 2.2$ Kgf/cm$^2$.

When the rolling piston 33 rotates further in the direction from the first intake port 36 toward the second intake port 38, and the contacting point A reaches the second intake port 38, the refrigerant comes into the cylinder from the second intake tube 23 for the air conditioning device 28 through the second intake port 38. This is because the pressure $P_{B2}$ at the point $B_2$ in the refrigerant cycle of the air conditioning device 28 as shown in FIG. 4 is 6.8 Kgf/cm$^2$, and $P_{B2} > P_{B3}$ holds.

When the air conditioning is not needed, the electronic expansion valve 6 and the solenoid controlled valve 30 are closed.

This allows the cycle as shown in FIG. 1 to be utilized as the refrigerating cycle exclusively for the refrigerator, and the temperature of the discharge gas from the compressor can be lowered. In this case, the use of inverter control could control the revolution or torque of an electric motor to obtain a highly efficient refrigerating cycle.

As explained, the first embodiment offers the following advantages:

(1) Even when the air conditioning device 28 is not driven, the shared compressor 21, the condenser 7, and the refrigerant R-22 constitute the refrigerating cycle of the refrigerator 29 which is successively driven, allowing the operating efficiency as the air conditioning system to be improved.

(2) Because the refrigerant R-22 can be used as a refrigerant 29 for the refrigerator, it is possible to dispense with the refrigerant R-12 which could discompose outside the atmosphere to decrease ozone.

(3) Since the compressor 21 of the air conditioning device 28 is installed outside and is shared with the refrigerator 29, it is not necessary to place an exclusive compressor in the refrigerator 29. This allows the inner volume of the refrigerator 29 to be increased accordingly.

(4) Because the outdoor compressor 21 of the air conditioning device 28 is shared with the refrigerator, it is not necessary to place a noisy compressor in the refrigerator 29. As a result, there is no possibility that the compressor generates noise in the room to give discomfort to a user, which has happened up to the present.

(5) Since the outdoor heat exchanger 7 which functions as a condenser outside on cooling is shared with the refrigerator 29 to be used as a condenser for the refrigerator as well, there is no possibility that the condensation heat radiated from the condenser of the refrigerator increases the temperature in the room at a hot time such as summer, which has happened up to now.

(6) When the air conditioning device is in use, the air conditioning device heat exchangers 5 and 7 having great capacity can be used to improve the refrigeration effect of the refrigerator 29.

The Second Embodiment

Figure 5:
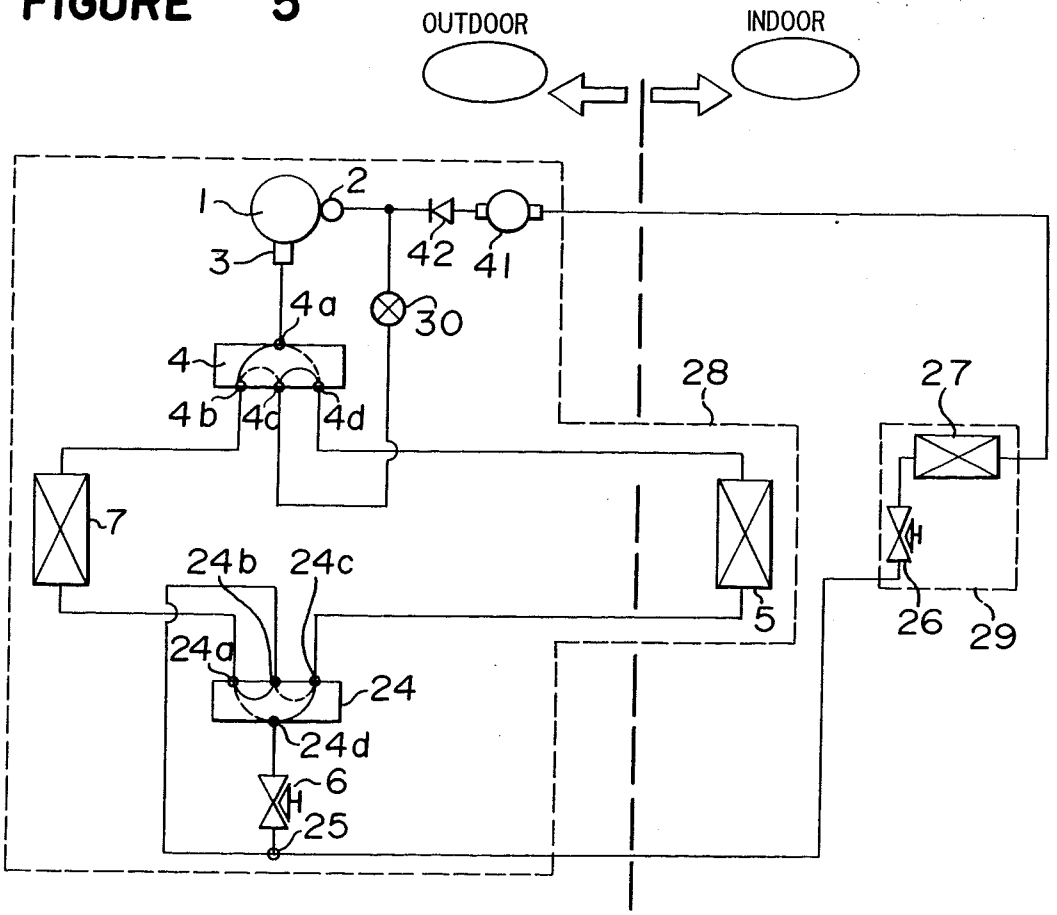
FIG. 5 is a structure diagram showing the basic cycle according to a second embodiment.

Although in the first embodiment the rotary compressor 21 has the first intake tube 22 and the second intake tube 23, a standard enclosed type of rotary compressor 1 which is used in conventional air conditioners and has one intake tube, a pressure pump 41, and a check valve 42 can be utilized instead of the compressor 21, which is shown as a second embodiment in FIG. 5.

If the pressure $P_{B3}$ (=2.2 Kg.f/cm$^2$) of the refrigerant which flows from the evaporator 27 of the refrigerator 29 is pumped up to higher than the pressure $P_{B2}$ (=6.8 Kg.f/cm$^2$) by the pressure pump 41, the check valve 42 is opened, and the refrigerant from the refrigerator 29 is inspired into the standard enclosed type of rotary compressor 1 together with the refrigerant from the air conditioning device 28.

The Third Embodiment

Figure 6:
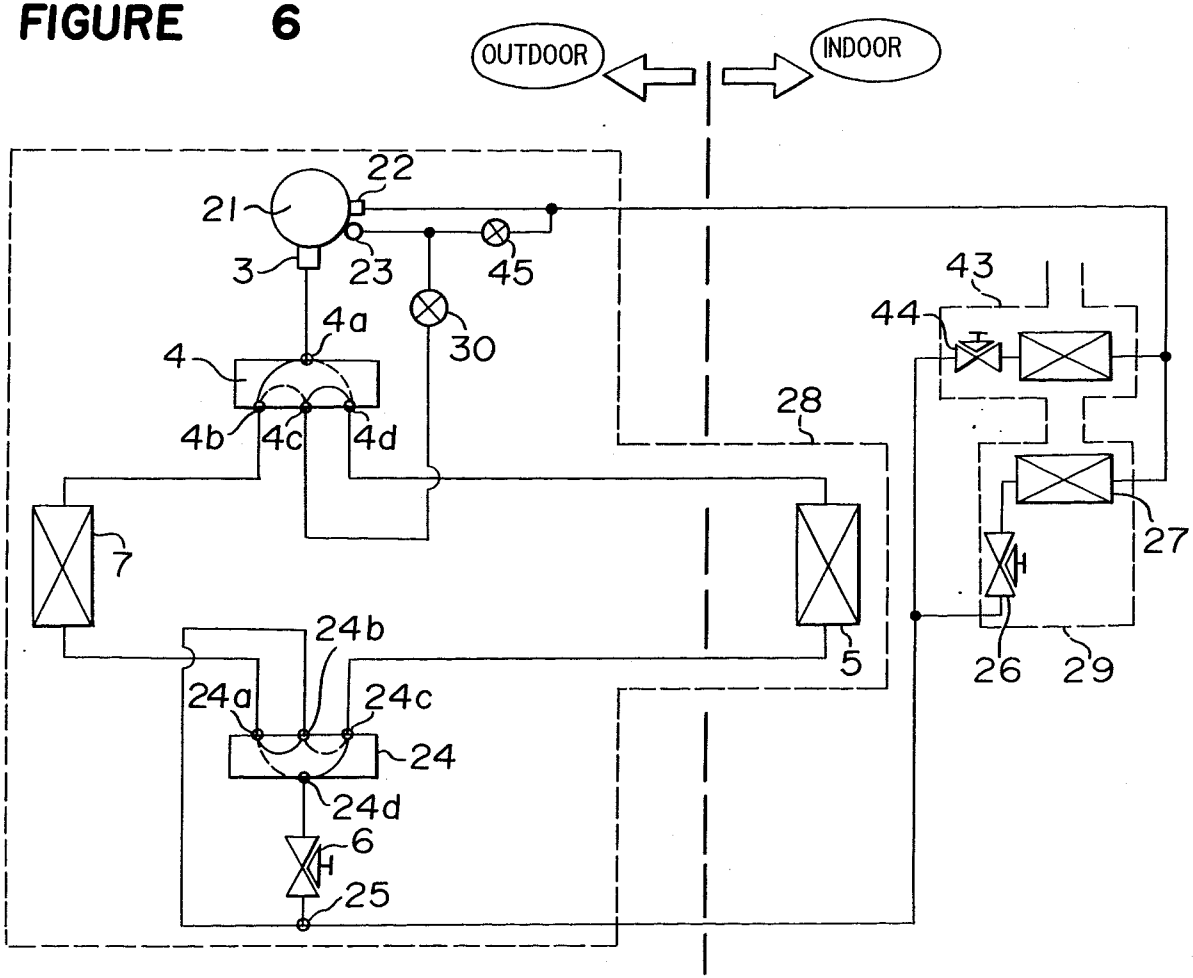
FIG. 6 is a structural diagram showing the basic cycle of a third embodiment.

A third embodiment of the present invention will be explained in reference to FIG. 6. In the third embodiment, when the air conditioning by the air conditioning device 28 is not required during, e.g., night time, cooling capacity (energy) except for the cooling capacity (energy) required for the refrigerator 29 is accumulated in a medium (e.g. turning water into ice) so that the accumulated cooling energy can be released in the refrigerator or in a room, as required. In the third embodiment, an ice accumulator 43 with an electronic expansion valve 44 at its refrigerant intake end is incorporated in the cooling cycle so as to be in parallel to the refrigerator 29 comprising the electronic expansion valve 26 and the evaporator 27, as shown in FIG. 6. There is also provided a solenoid controlled valve 45 in a tube which connects between the tube from the refrigerator 29 and the tube from the solenoid controlled valve 30. In order to accumulate the cooling energy, the electronic expansion valve 6 is completely closed, and the electronic expansion valve 44 adjusts the refrigerant so that the ice accumulator 43 can make ice. The solenoid controlled valve 45 is opened, and the solenoid controlled valve 30 is closed. This allows the ice made by the ice accumulator 43 to be used for refrigerating the inside of the refrigerator 29, and to produce cooled air by the ice and feed it in a room to cool the inside of the room.

The Fourth Embodiment

Figure 7:
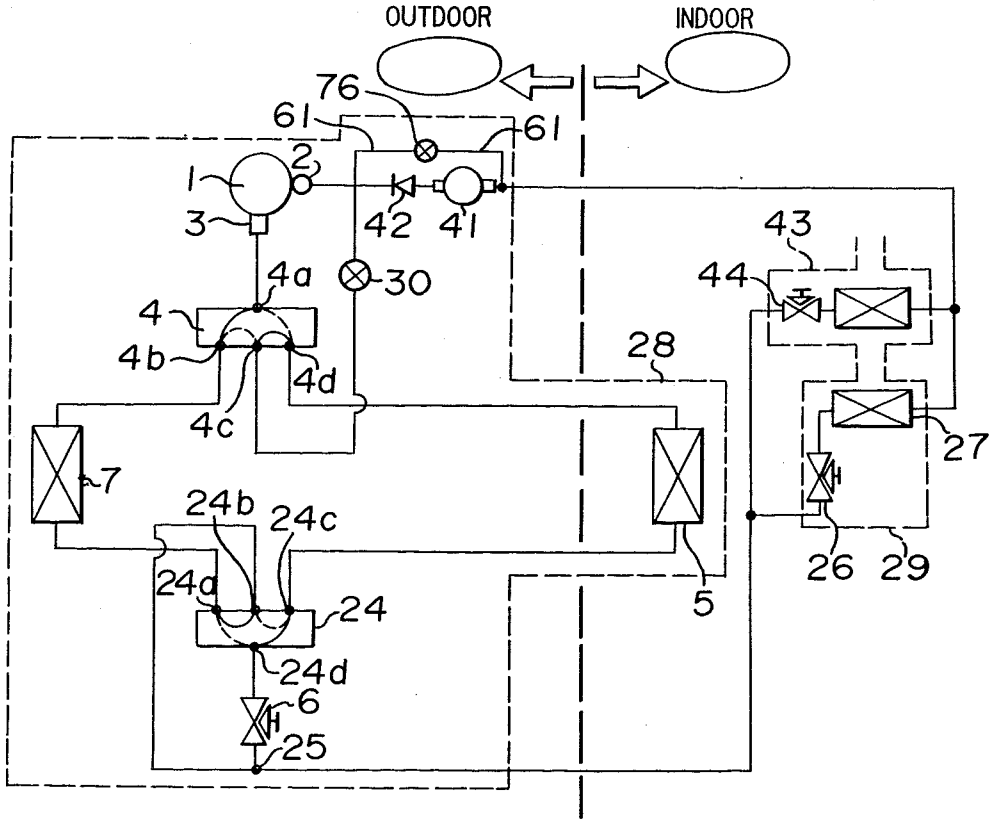
FIG. 7 is a structural diagram showing the basic cycle of a fourth embodiment.

Although in the third embodiment as shown in FIG. 6, the rotary compressor 21 according to the present invention is employed, the standard enclosed type of rotary compressor 1, the pressure pump 41, and the check valve 42 as shown in FIG. 5 can be used instead of the rotary compressor 21 to obtain a similar effect, which is a fourth embodiment as shown in FIG. 7. In the fourth embodiment, the pressure pump 41 and the check valve 42 are bypassed (short-circuited) by means of a tube 61 with a solenoid controlled valve 76 in it. This arrangement compares with the arrangement in FIG. 6 wherein the solenoid controlled valve 45 is opened to allow the refrigerant to flow into the second intake tube 23 as well in order to inspire more refrigerant returning from the refrigerator 29. In the fourth embodiment as shown in FIG. 7, the pressure pump 41 and the check valve 42 must be bypassed in order to effectively use the compressor 1 having greater pump displacement than the pressure pump 41 because the pressure pump 41 usually has smaller pump displacement than the compressor 1. Thus, unless they are bypassed, the arrangement would function to flow the refrigerant towards the refrigerator 29 at the maximum amount.

In the fourth embodiment, a similar effect to the second embodiment as shown in FIG. 5 can be obtained by driving only the compressor 1 without driving the pressure pump 41. In this case, the electronic expansion valve 6 and the solenoid controlled valve 30 are closed like in the third embodiment as shown in FIG. 6.

The Fifth Embodiment

Figure 8:
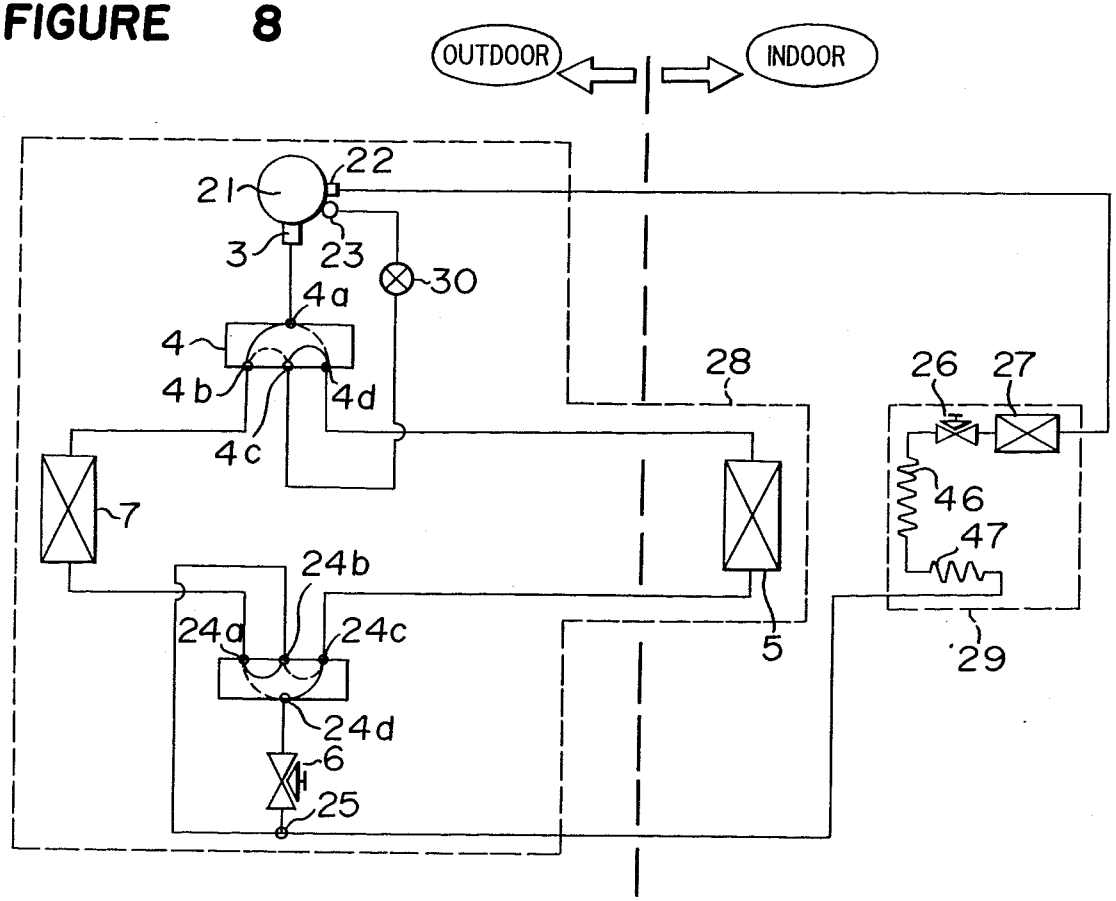
FIG. 8 is a structural diagram showing the basic cycle of the fifth embodiment.

By the way, when a condenser exclusively for the refrigerator 29 is employed to control the operation conditions as the refrigerator with higher precision and deal with drainage, the arrangement of a fifth embodiment as shown in FIG. 8 can be adopted. The fifth embodiment is different from the first embodiment as shown in FIG. 1 in that a condenser exclusively for a refrigerator or cabinet pipe 46 and a drainage evaporating subcondenser 47 are connected in series between the T-pipe joint 25 and the electronic expansion valve 26.

The advantage offered by the air conditioning system with a refrigerator integrated is that a heat exchanger which is arranged for the air conditioning device and has higher temperature and a greater area for heat exchange can be also used as a condenser for the refrigerator to improve the cooling capacity of the refrigerator and to realize effective refrigerating operation. However, if the temperature at the outlet of the heat exchanger having higher temperature becomes too low due to the greatness of the heat exchanger area, the temperature of the refrigerant in the cabinet pipe 46 and the drainage evaporating subcondenser 47 of the refrigerator as shown in FIG. 8 could become low accordingly to deteriorate frost prevention effect on the surface of the refrigerator cabinet by drainage evaporation effect. In the fifth embodiment as shown in FIG. 8, the outdoor heat exchanger 7 becomes a higher temperature of heat exchanger on cooling, and the temperature at the outlet of the outdoor heat exchanger 7 could lower at, for example, a case wherein the outdoor temperature lowers. A sixth embodiment as shown in FIG. 9 can overcome this problem.

The Sixth Embodiment

In the sixth embodiment, the discharge tube 3 of the compressor 1 is connected to the inlet of the drainage evaporating subcondenser 47 through a tube 62 with a solenoid controlled valve 79 in it. If the temperature at the outlet of the outdoor heat exchanger 7 lowers and the temperature at the inlet of the drainage evaporating subcondenser 47 becomes too low, the solenoid controlled valve 79 is opened. If the temperature at the inlet of the drainage evaporating subcondenser 47 becomes more than a predetermined temperature, the solenoid controlled valve 79 is closed. This arrangement allows the temperature of the cabinet pipe 46 and that of the drainage evaporating subcondenser 47 to be maintained at an effective temperature while maintaining the temperature before the electronic expansion valve 26 of the refrigerator as low as possible (maintaining the refrigerator performance of the refrigerator).

Figure 9:
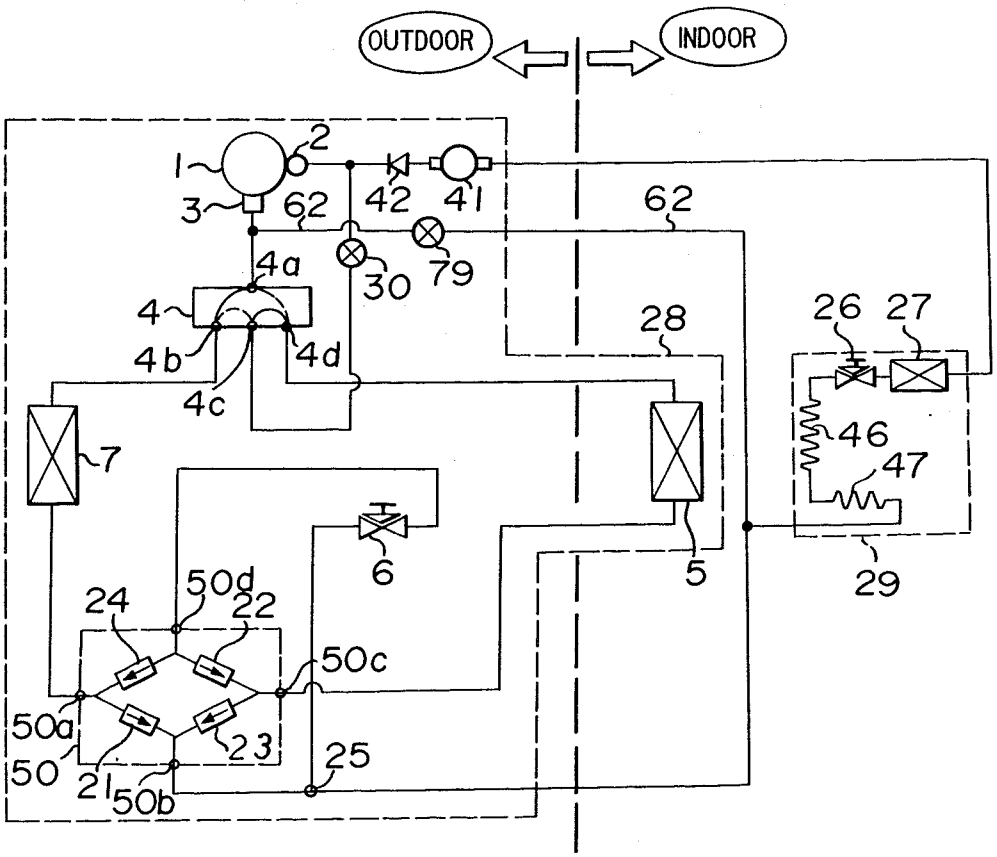
FIG. 9 is a structural diagram showing the basic cycle of the sixth embodiment.

A switching circuit 50 as shown in FIG. 9 will be described later on.

By the way, the second four port valve 24 is used for switching operation in the first through fifth embodiments. The second four port valve 24 generally has a structure wherein its main body is made of a metallic tube, the connecting ports **24*a*, 24*b*, 24*c* and 24*d* are formed adjacent to each other, and a slider in the body can be moved under the action of electromagnetic force depending on the switching to the cooling operation and the heating operation. Because a gas having higher temperature and a gas having lower temperature flow adjacent each other in the metallic tube, there is thermal leakage (thermal loss) in the second four port valve 24. In addition, because the second four port valve 24** is a small device in terms of volume, there is great pressure loss in operation.

Embodiments wherein a check valve bridge as the switching circuit is utilized instead of the four port valve 24 will be explained.

The Seventh Embodiment

Firstly, a seventh embodiment wherein a check valve bridge 50 is utilized instead of the second four port valve 24 in the second embodiment as shown in FIG. 5 will be described with reference to FIG. 10.

Figure 10:
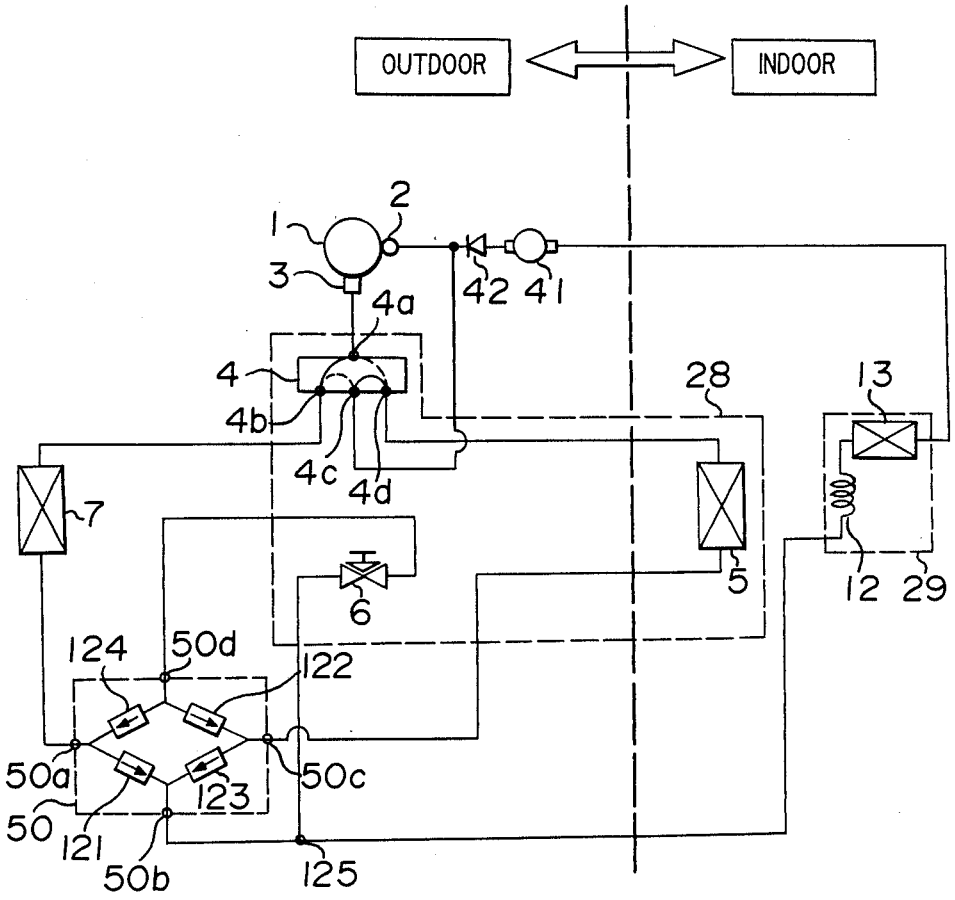

In FIG. 10, reference numeral 50 indicates a bridge circuit comprising four check valves 121, 122, 123 and 124. The bridge circuit 50 is of such structure that the check valves 121 and 122 opposite to each other, or the check valves 123 and 124 opposite to each other, have the same porality (the same flowing direction) as each other, and the check valves are combined in the form of bridge with four connecting points 50*a*, 50*b*, 50*c* and 50*d*. The discharge tube 3 of the compressor 1 is connected to one each of the outdoor heat exchanger 7 through the four port valve 4 like the second embodiment as shown in FIG. 5. The other end of the outdoor heat exchanger 7 is connected to one end 50*a* of the bridge circuit, 50 and the other end 50*c* of the bridge circuit 50 is connected to one end of the indoor heat exchanger 5. The middle point 50*b* of the bridge circuit 50 is led to one end of the electronic expansion valve 6 in the air conditioning device 28, and one end of the capillary tube 12 in the refrigerator 29 through a T-pipe joint 125. The other middle point 50*d* of the bridge circuit 50 is connected to the other end of the electronic expansion valve 6. In addition, the other end of the indoor heat exchanger 5 is connected to the intake tube of the compressor 1 through the four port valve 4. On the other hand, the other end of the capillary tube 12, which is one part of the refrigerator 29, is connected to one end of the evaporator 13. The other end of the the evaporator 13 is led to the intake side of the pressure pump 41. The discharge side of the pressure pump 41 is connected to the intake tube 2 of the compressor 1 through the check valve 42.

In the check valve bridge 50, the refrigerant flows through the check valves opposite to each other the way that a higher temperature part of the refrigerant flows through the check valve 121 and a lower temperature part flows through the check valve 122 on cooling. This arrangement allows the thermal loss at the check valve bridge 50 to be lower in comparison with the second four port valve 24. In addition, the four check valves which have the same size as the tube used in the air conditioning device 28, can be used to minimize the pressure loss. The check valve bridge 50 using four check valves can be manufactured at lower cost in comparison with the four port valves which are commercially available at present. Because the check valve bridge does not need electromagnetic force, it has no thermal source, and it is contributory to decreasing required electric power.

In accordance with the present invention, the cooling circuit of the air conditioning device is shared to carry out the refrigeration for the refrigerator by use of the same refrigerant. As a result, the system requires not only parts for the air conditioning device but also parts for the refrigeration of the refrigerator. On the other hand, the refrigerator according to the present invention does not house in its cabinet some of the parts which have been required in the conventional refrigerators because the refrigerator according to the present invention shares some parts with the air conditioning device. In order to facilitate the description on the present invention, the parts used exclusively for the air conditioning device are called air conditioning device elements, and the parts which are housed in the refrigerator cabinet in a room are called refrigerator elements in this specification. In FIG. 10, the air conditioning device elements are surrounded by a dotted line 28, and the refrigerator elements are surrounded by a dotted line 29.

When the same refrigerant is used to operate both the air conditioning device and the refrigerator, the pressure at the lower temperature side of the refrigerator is lower than the pressure at the lower temperature side of the air conditioning device. For that reason, the pressure of the refrigerant returning to the evaporator 13 in the refrigerator 29 is raised to the pressure at the lower temperature side of the air conditioning device by the pressure pump 41. The check valve 42 is used in order to prevent the lower temperature refrigerant returning from the air conditioning device 28 from flowing back to the pressure pump 41.

When a device for cooling and heating like the air conditioning device is combined with a device for refrigeration, a gas having high temperature and high pressure must be supplied to the inlet of the capillary tube 12 of the refrigerator 29 i.e., to the T-pipe joint 125 regardless of the cooling and heating operation of the air conditioner.

Figure 20:
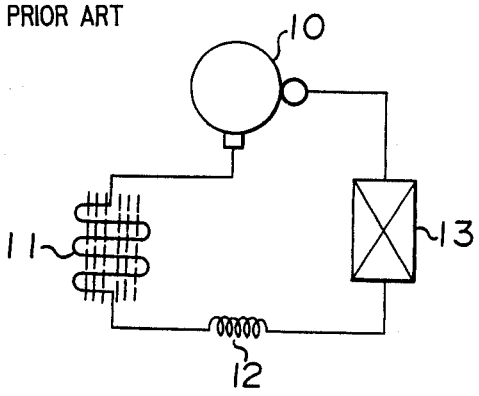
FIGURE 20 PRIOR ART
FIG. 20 is the circuit diagram in the conventional refrigerator.

When the air conditioning device 28 needs cooling operation, the first four port valve 4 takes the position indicated in the solid lines so that the gaseous refrigerant having high temperature which is discharged from the discharge tube 3 of the compressor 1 is led to the outside heat exchanger 7 through the connecting ports 4*a* and 4*b*. Namely, the outside heat exchanger 7 becomes a higher temperature heat exchanger on cooling. The gaseous refrigerant having high temperature which is led from the outside heat exchanger 7 to the connecting point 50*a* of the check valve bridge 50 can not go through the check valve 124, but can go through the check valve 121. The gaseous refrigerant having high temperature which has passed through the check valve 121 moves towards the connecting point 50*b* because the check valve 123 prevents the gaseous refrigerant from entering. As a result, the gaseous refrigerant having high temperature is led to the T-pipe joint 125. The refrigerant which moves towards the refrigerator 29 after it has passed through the T-pipe joint 125 flows in the course of the capillary tube 12, the evaporator 13, the pressure pump 41, the check valve 42, and the compressor 1 to form the cooling circuit as explained in reference to FIG. 20 showing the conventional refrigerator, allowing the refrigerator elements to be operated as a refrigerator. On the other hand, the refrigerant which moves towards the air conditioning device 28 after having passed through the T-pipe joint 125 passes through the expansion valve 6, and it moves towards the connecting point 50*d* of the check valve bridge 50 in the form of liquid refrigerant having low pressure. The liquid refrigerant is led to the indoor heat exchanger 5 through the check valve 122 because the pressure at the connecting point 50*a* is higher than that at the connecting point 50*d* to prevent the check valve 124 from opening. After that, the refrigerant flows to the intake tube 2 of the compressor 1 through the connecting ports 4*d* and 4*c* of the four port valve 4, carrying out cooling operation similar to the conventional air conditioner.

When the air conditioning device 28 requires room heating operation, the four port valve 4 takes the position indicated in dotted lines, thereby directing the gaseous refrigerant having high temperature from the discharge tube 3 of the compressor 1 to the indoor heat exchanger 5 through the connecting ports 4*a* and 4*d*. Namely, the indoor heat exchanger 5 becomes a higher temperature heat exchanger on heating. The gaseous refrigerant which has high temperature and high pressure and which is led from the indoor heat exchanger 5 to the connecting point 50*c* of the check valve bridge 50 passes through the check valve 123 because it is prevented from passing through the check valve 122. The gaseous refrigerant which has passed through the check valve 123 goes to the connecting point 50*b* because it is prevented from passing through the check valve 121.

As a result, the refrigerant is directed to the T-pipe joint 125. Namely, when the air conditioning device 28 carries out room heating operation, the gaseous refrigerant having high temperature and high pressure is also supplied to the refrigerator elements 29, which is the same as the air conditioning device elements carry out cooling operation. The refrigerant which has passed through the T-pipe joint 125 and goes to the air conditioning device 28 passes through the expansion valve 6, and it goes to the connecting point **50*d* in the form of a liquid having low pressure. The liquid refrigerant passes through the check valve 124 because the pressure at the connecting point 50*d* is not higher than that at the connecting point 50*c*, and the check valve 122 prevents the liquid refrigerant from passing through it. The refrigerant is led to the outdoor heat exchanger 7, and it flows to the intake tube 2 of the compressor 1 through the connecting ports 4*b* and 4*c* of the four port valve 4**. This means that, when the air conditioning device carry out heating operation, they perform heating operation similar to the conventional air conditioners.

The Eighth Embodiment

Figure 11:
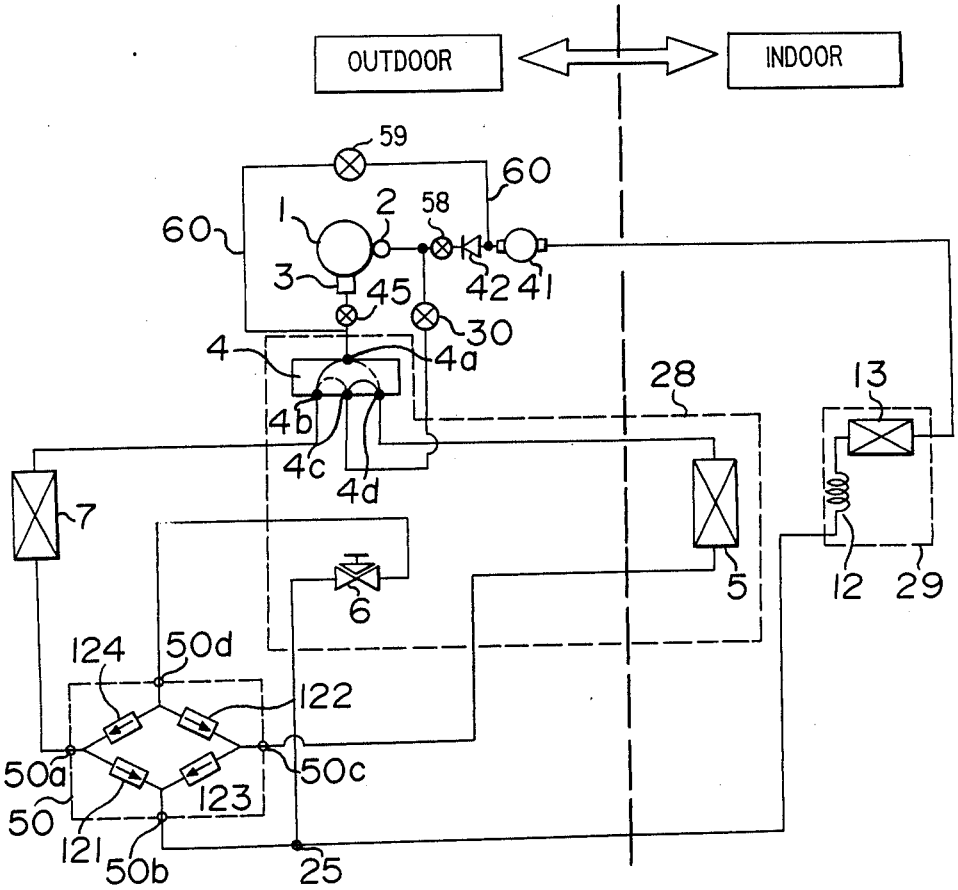

In the seventh embodiment, the compressor 1 and the pressure pump 41 are used to operate the air conditioning device 28 and the refrigerator elements 29. If the arrangement of an eighth embodiment as shown in FIG. 11 is adopted, the refrigerator 29 can be effectively operated when it is not necessary to operate the air conditioning device 28. In the eighth embodiment, a tube 60 with a solenoid controlled valve 59 in it extends from the tube between the pressure pump 41 and the check valve 42, and it is connected to the tube between the discharge tube 3 of the compressor 1 and the four port valve 4. The solenoid controlled valve 45 is arranged between the discharge tube 3 and the connecting point at which the tube 60 is connected to the tube connecting the discharge tube 3 to the four port valve 4. The solenoid controlled valve 30 is arranged in the tube which connects the connecting port **4*c* of the four port valve 4 to the intake tube 2 of the compressor 1. This arrangement allows the refrigerator 29 to carry out refrigeration by the use of only the pressure pump 41 without using the compressor 1. Although the refrigerator 29 can perform the refrigeration by the use of only the compressor 1, it is in general not effective that the compressor having a great pump displacement is used to cool a small cooling load. It is preferable that only the pressure pump having small pump displacement is driven, and the solenoid controlled valves 30, and 45 and a solenoid controlled valve 58 are closed with the solenoid controlled valve 44 opened to carry out the refrigeration in the refrigerator elements when the operation of the air conditioning device elements is not required. The operation of only the pressure pump 41 by the use of the circuit according to the present invention is advantageous in terms of reliability and prolonged life of the pressure pump. Specifically, the area of the radiating surface of the higher temperature of heat exchanger 7 is remarkably greater than the meander shape of the condenser 11 used in the conventional refrigerators. When R-22 is used as the refrigerant, the saturation absolute pressure in the higher temperature of heat exchanger 7 is about 18 $Kg/cm^2$ abs even in midsummer when the outside temperature is 43° C. If the evaporation temperature in the evaporator 13** is −30° C., the saturation absolute pressure in the evaporator is about 3 $Kg/cm^2$ abs. As a result, the compression ratio of the pressure pump is about 6, which is smaller than the compression ratio, about 10, of the compressor utilized to refrigerate a refrigerator by the use of R-12.

The Ninth Embodiment

Figure 12:
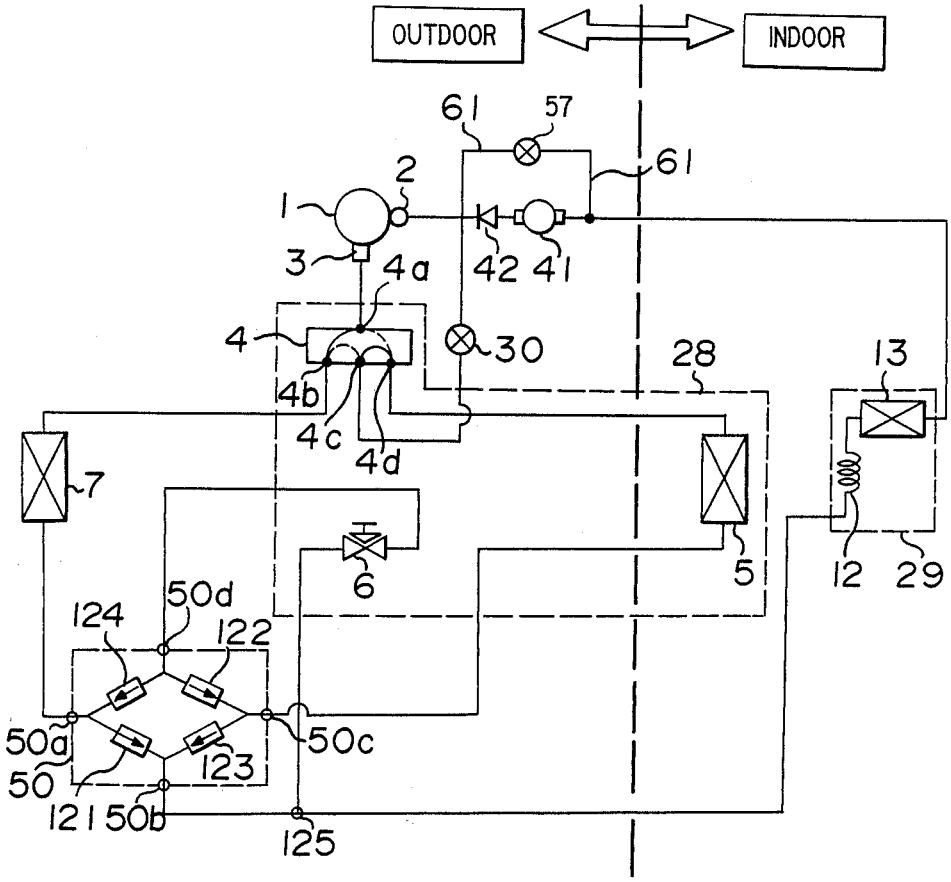

There is a case wherein the operation of the air conditioning device 28 is not needed like the eighth embodiment but the refrigerator 29 is required to have great refrigeration capacity. At that case, the operation of the pressure pump 41 is stopped, and only the compressor 1 is driven to carry out the refrigeration of the refrigerator 29, which is a ninth embodiment as shown in FIG. 12. In the ninth embodiment, the tube 61 with a solenoid controlled valve 57 in it extends from the tube at the intake side of the pressure pump 41, and it is connected to the tube between the check valve 42 and the intake tube 2 of the compressor 1. The solenoid controlled valve 30 has the purpose of preventing the refrigerant from circulating to the air conditioning device 28. The use of the compressor 1 having great pump displacement for the refrigeration operation of the refrigerator 29 allows the system not only to be applied to a refrigerator having great content volume but also to carry out fast refrigeration or quick freezing which is required for cooling food in a short time.

The Tenth Embodiment

Figure 13:
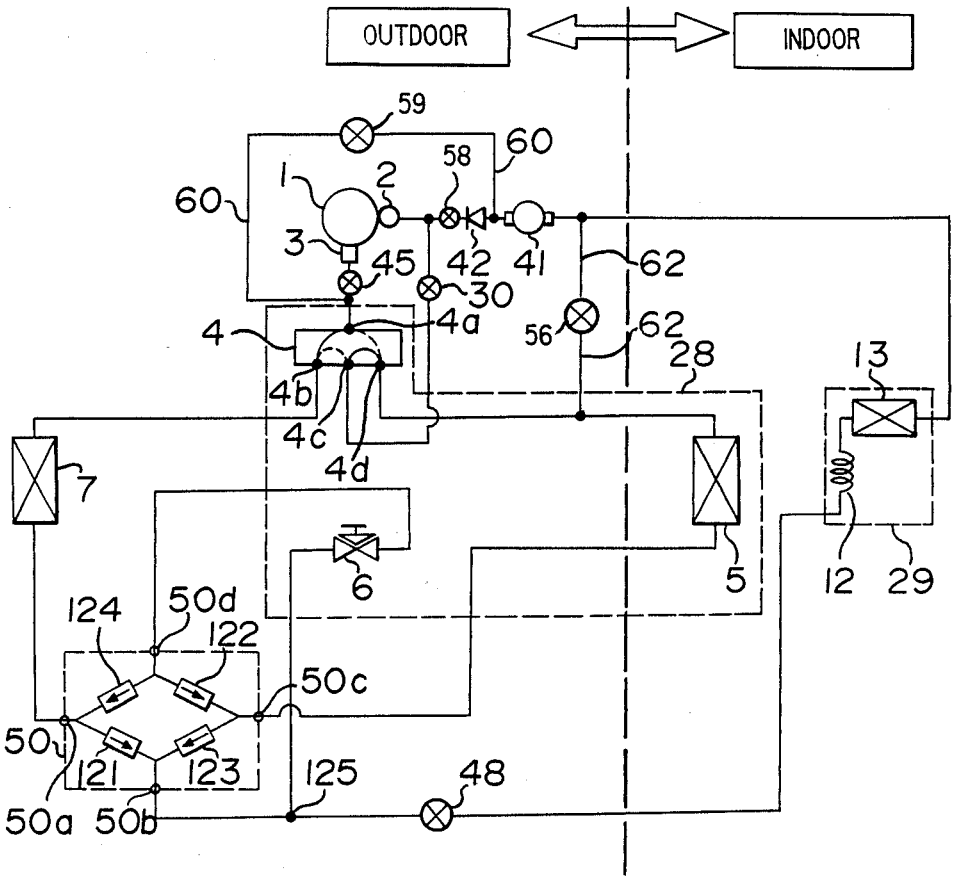

When the operation of the refrigerator 29 is not required, the arrangement of a tenth embodiment as shown in FIG. 13 can be adopted to make the pressure pump 41 contribute to room cooling and room heating operation of the air conditioning device 28. The tenth embodiment is different from the eighth embodiment as shown in FIG. 11 in that the tube 62 with a solenoid controlled valve 56 in it connects the connecting port **4*d* of the four port valve 4 to the intake side of the pressure pump 41 and that a solenoid controlled valve 48 is arranged in the tube between the T-pipe joint 125 and the capillary tube 12 to prevent the refrigerant from moving to the refrigerator 29**.

When the operation of the refrigerator 29 is not required, the compressor 1 and the pressure pump 41 are driven in parallel to increase the cooling and the heating capacity of the air conditioning device 28. At that time, the solenoid controlled valves 30, 59, 45, and 56 are opened, but the solenoid controlled valves 58 and 48 are closed.

The operation on cooling will be explained. The refrigerant which returns from the indoor heat exchanger 5 as a lower pressure of heat exchanger passes through the connecting ports **4*d* and 4*c* of the four port valve 4, and returns to the compressor 1 like the usual cycle. The refrigerant returning from the indoor heat exchanger 5 also passes through the tube 62, flows in the course of the pressure pump 41, the tube 60, and the four port valve 4. In this way, the pressure pump 41 is driven in parallel with the compressor 1**.

The system of the seventh through tenth embodiments as shown in FIGS. 10 through 13 is characterized in that it includes the refrigerant circuit comprising the compressor, the four port valve, the outdoor heat exchanger, the decompression device, and the indoor heat exchanger; the bridge rectification circuit comprising the check valves, having its input end connected to the outdoor heat exchanger and the indoor heat exchanger, and having its output end connected to the decompression device; the air conditioning device comprising the four port valve, the indoor heat exchanger, and the decompression device; and the refrigerator which is arranged in parallel with the air conditioning device, and comprises the capillary tube and the evaporator; wherein at the time of food-refrigerating and room-cooling operation, the refrigerant is compressed by the compressor, the compressed refrigerant is condensed in the outdoor heat exchanger, the condensed refrigerant is divided in parts for the air conditioning elements and for the refrigerator elements to be evaporated in the respective routes, and the evaporated parts from the respective routes are joined and returned to the compressor; and wherein, at the time of food-refrigerating and room-heating operation, the refrigerant is compressed by the compressor, the compressed refrigerant is condensed in the indoor heat exchanger, the condensed refrigerant is divided in parts for the refrigerator elements and for the decompression device, the part decompressed in the decompression device is evaporated in the outdoor heat exchanger, and the part evaporated in the outdoor heat exchanger is joined with the part evaporated in the refrigerator route and returned to the compressor, thereby allowing the refrigerator elements to carry out refrigeration regardless of the cooling and the heating operation in the air conditioning device.

The Eleventh Embodiment

Figure 14:
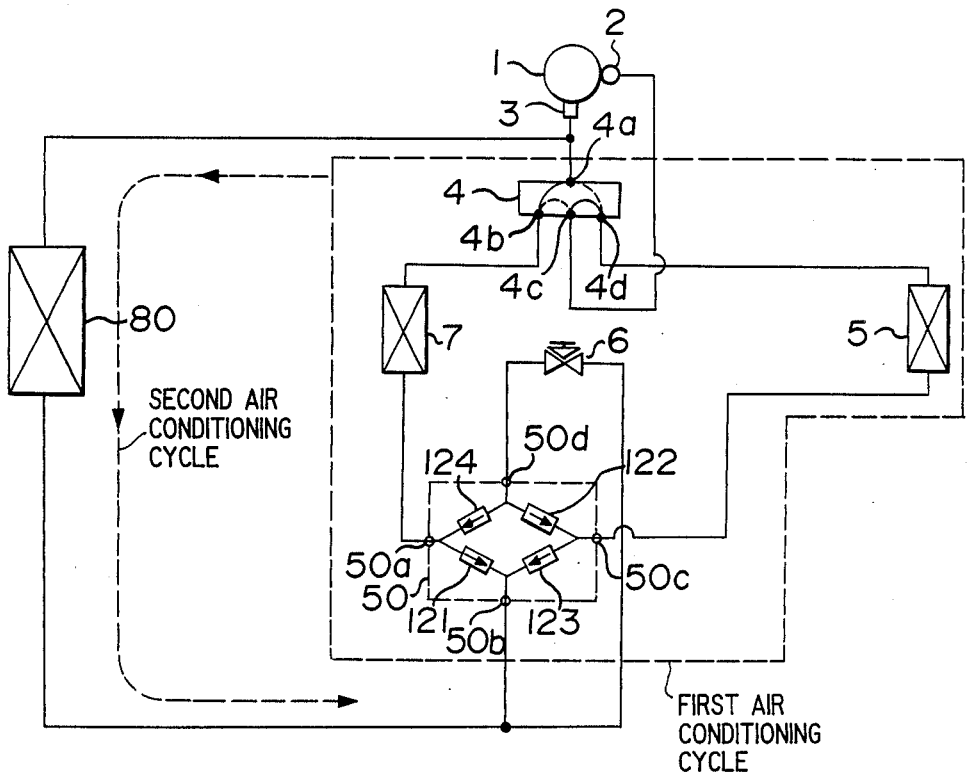

Although the case of using the check valve bridge 50 in the air conditioning system with the refrigerator integrated has been described, the check valve bridge is effective in a system wherein a first air conditioning cycle reversible between room cooling and room heating is combined with a second air conditioning cycle carrying out one direction operation (i.e., either room cooling or room heating). Such a system will be explained as an eleventh embodiment as shown in FIG. 14. In FIG. 14, the first air conditioning cycle comprises a circuit for carrying out both room cooling and room heating, and the second air conditioning cycle includes a radiator 80 for a warming cabinet. The radiator 80 has one end connected to a middle point between the discharge tube 3 of the compressor 1 and the connecting port 4*a* of the four port valve 4, and the other end connected to a middle point between the connecting port 50*b* of the check valve bridge 50 and the electronic expansion valve 6. The radiator 80 can receive the gaseous refrigerant discharged from the compressor 1 to become hot, warming a thing such as a towel. When the first air conditioning cycle carries out the cooling operation, the refrigerant having high temperature flows in the course of the outside heat exchanger 7, the check valve 121, and the electronic expansion valve 6. On the other hand, the refrigerant having high temperature and passing through the second air conditioning cycle passes through the radiator 80 and flows to the electronic expansion valve 6. In this way, the refrigerant in the second air conditioning cycle joins the refrigerant in the first air conditioning cycle, and the first and the second air conditioning cycle can be operated without conflict.

When the first air conditioning cycle carries out the room heating operation, the refrigerant having high temperature flows in the course of the indoor heat exchanger 5, the connecting point 50*c*, the check valve 123, the connecting point 50*b*, and the electronic expansion valve 6. The refrigerant in the second air conditioning cycle joins the refrigerant in the first air conditioning cycle before the electronic expansion valve 6, which is the same as the first air conditioning cycle, carries out the room cooling operation. As a result, a heater included in the first air conditioning cycle and the warming cabinet included in the second air conditioning cycle can be operated simultaneously.

The air conditioning system with the warming cabinet integrated of the eleventh embodiment as shown in FIG. 14 is characterized in that it includes the refrigerant circuit comprising the compressor, the four port valve, the outdoor heat exchanger, the decompression device, and the indoor heat exchanger; the bridge rectification circuit comprising the check valves, having its input end connected to the outdoor heat exchanger and the indoor heat exchanger, and having its output end connected to the decompression device; and the radiation for the warming cabinet; wherein at the time of warming operation and room cooling operation, the refrigerant is compressed by the compressor, the compressed refrigerant discharged from the compressor is divided in parts for the circuit which comprises the four port valve and the outdoor heat exchanger in the refrigerating circuit and has higher pressure at the room cooling operation, and for the radiator, the parts are condensed in each route, the condensed parts are joined, the joined one is passed through the decompression device, the indoor heat exchanger and the four port valve in this order, and the joined one is returned to the compressor; and wherein at the time of warming operation and room-heating operation, the refrigerant is compressed by the compressor, the compressed refrigerant discharged from the compressor is divided in parts for the circuit which comprises the four port valve and the indoor heat exchanger in the refrigerant circuit and has higher pressure at the time of room-heating operation, and for the radiator, the divided parts are condensed in each route, the divided parts are joined, the joined one is passed through the decompression device, the outdoor heat exchanger and the four port valve in this order, and it is returned to the compressor, thereby allowing the radiator to be heated regardless of the cooling and the heating operation in the air conditioning device elements.

The Twelfth Embodiment

Next, a twelfth embodiment wherein the revolutions of the compressor 1 and the pressure pump 41 can be controlled will be described with reference to FIG. 15.

In the system according to the present invention, the compressor 1 and the pressure pump 41 can have a structure wherein the refrigeration circulation can be controlled, and the revolutions of them can be changed to realize various kind of operations, thereby allowing the operations of the air conditioning device 28 and the refrigerator 29 to be changed. In this case, the revolutions of the compressor 1 and the pressure pump can be independently controlled by adopting a structure wherein inverter type of induction motor drive or dc-brushless electric motor drive is used to drive both the compressor 1 and the pressure pump 41, a rectification circuit 71 for the drive source is shared as shown in FIG. 15, a power transistor circuit 72 is used for the compressor 1, and a power transistor circuit 73 is used for the pressure pump 41. This structure can provide an economical revolution control circuit 71 because the rectification circuit is shared.

Figure 15:
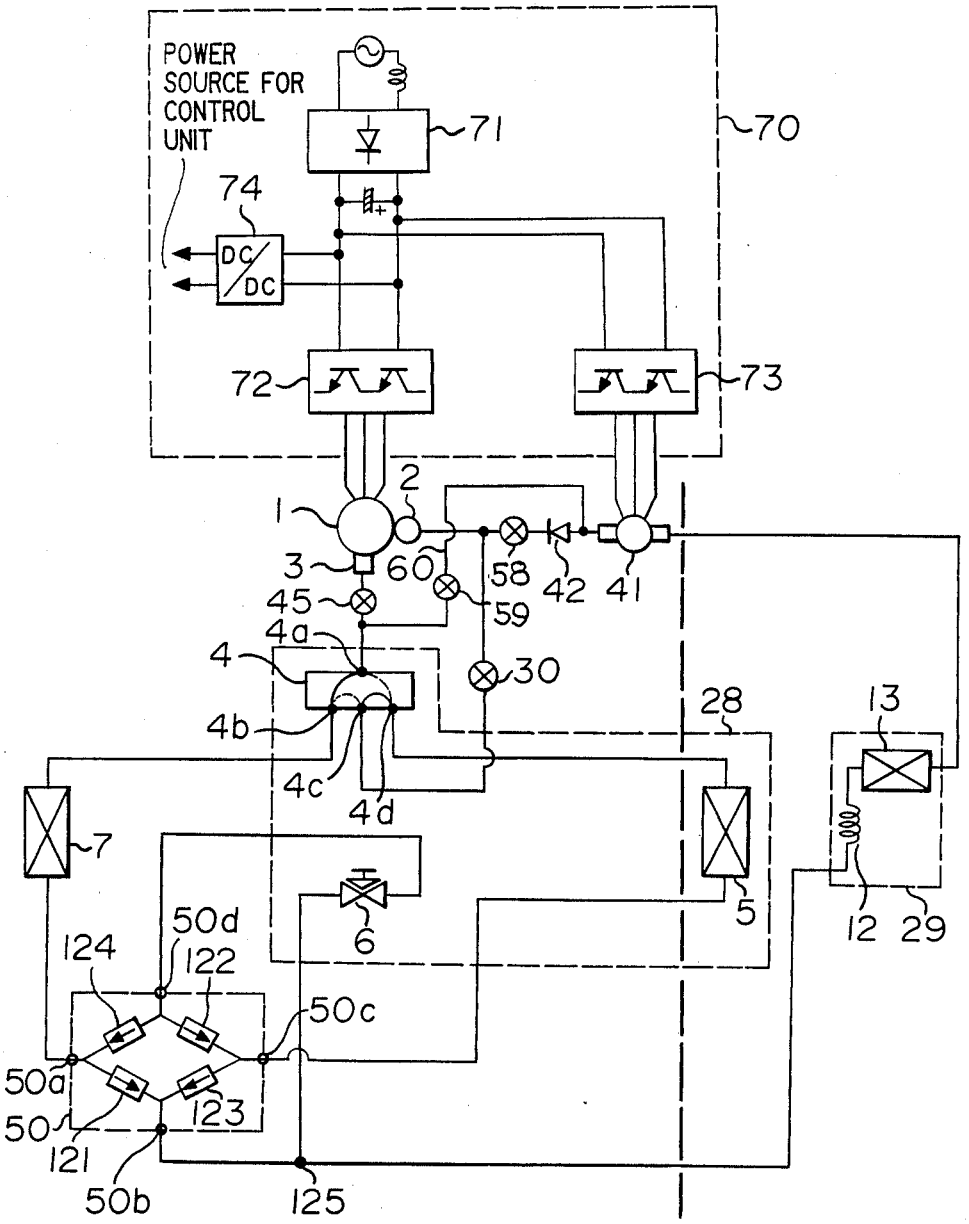

The power circuit of the twelfth embodiment as shown in FIG. 15 can be provided at low cost because the pressure adjusting means for the compressor 1 and that for the refrigerator 29 share a rectification circuit 71 for the inverter drive.

In the twelfth embodiment of FIG. 15, when it is not necessary to operate the air conditioning device 28, the expansion valve 6, and the solenoid controlled valves 30, 58 and 45 are closed with the solenoid controlled valve 59 opened. As a result, a part of the refrigerant is trapped in the lower pressure circuit between the expansion valve 6 and the compressor 1. However, there could happen a case wherein the refrigerant, the amount of which is more than that of the refrigerant required for operating the refrigerator 29, is enclosed in the circuit comprising the pressure pump 41, the four port valve 4, the outdoor heat exchanger 7, the check valve bridge 50, and the refrigerator 29, because the amount of the refrigerant required for operating the refrigerator 29 is, in general, remarkably small. In this case, the solenoid controlled valve 30 is opened, the compressor 1 is restarted and the opening degree of the electronic expansion valve 6 is adjusted, allowing the refrigerant to be inspired into the compressor 1 and the indoor heat exchanger 5 again. Namely, when the compressor 1 is restarted, the refrigerant which remains in the indoor heat exchanger 5 and has low temperature and low pressure is returned to the compressor 1 through the intake tube 2. Refrigerating machine oil which can be well-mixed with the refrigerant is enclosed in the compressor 1, and the refrigerant having low temperature is held in the compressor 1 (the solenoid controlled valve 45 is closed). On the other hand, the refrigerant from the electronic expansion valve 6 is held in the indoor heat exchanger 5 because the pressure in the indoor heat exchanger 5 is further lowered by the compressor 1. The more amount of the refrigerant is held in the compressor 1, the higher the discharge pressure of the compressor 1 rises, increasing the energizing current for the compressor 1 gradually. The operation of the compressor 1 can be stopped by sensing the current to the compressor, or by sensing the discharge pressure. The compressor 1 may be stopped when a predetermined time has passed. When the compressor 1 is stopped in this way, the accumulation of the refrigerant into the air conditioning device circuit can be considered to have been completed, and the solenoid controlled valve 30 and the electronic expansion valve 6 are closed, thereby allowing the amount of the refrigerant required for the refrigerator elements 29 to be properly adjusted.

When the room heating is carried out, the four port valve 4 takes the position indicated in dotted lines, and the functions of the indoor heat exchanger 5 and the outdoor heat exchanger 7 which have been described at the time of room cooling are exchanged.

Figure 16:
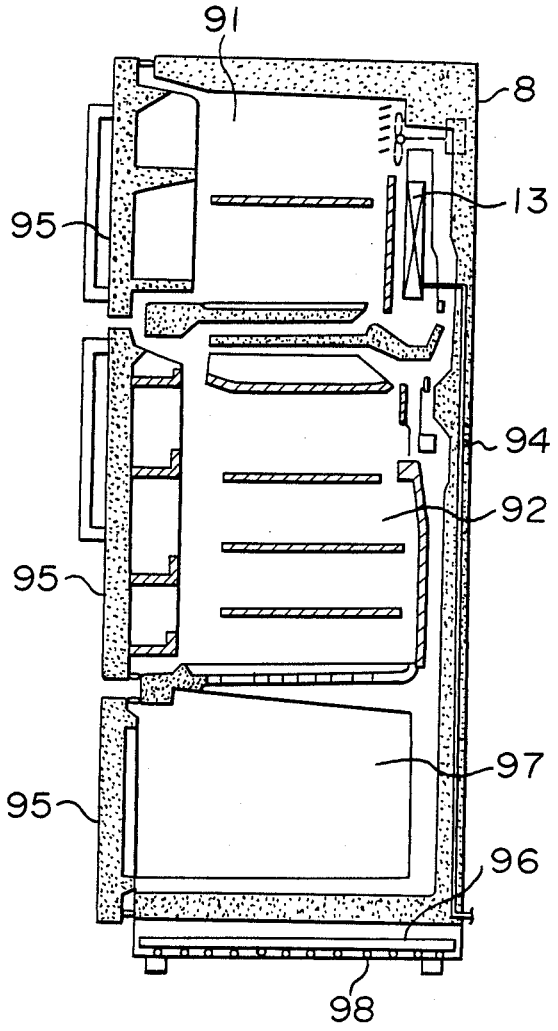
FIG. 16 is a vertical cross section showing a three door type of refrigerator according to the present invention.
Figure 19:
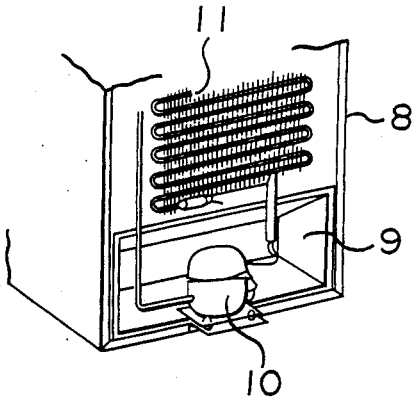
FIGURE 19 PRIOR ART
FIG. 19 is a perspective view showing the essential parts in the rear side of the conventional refrigerator.
Figure 21:
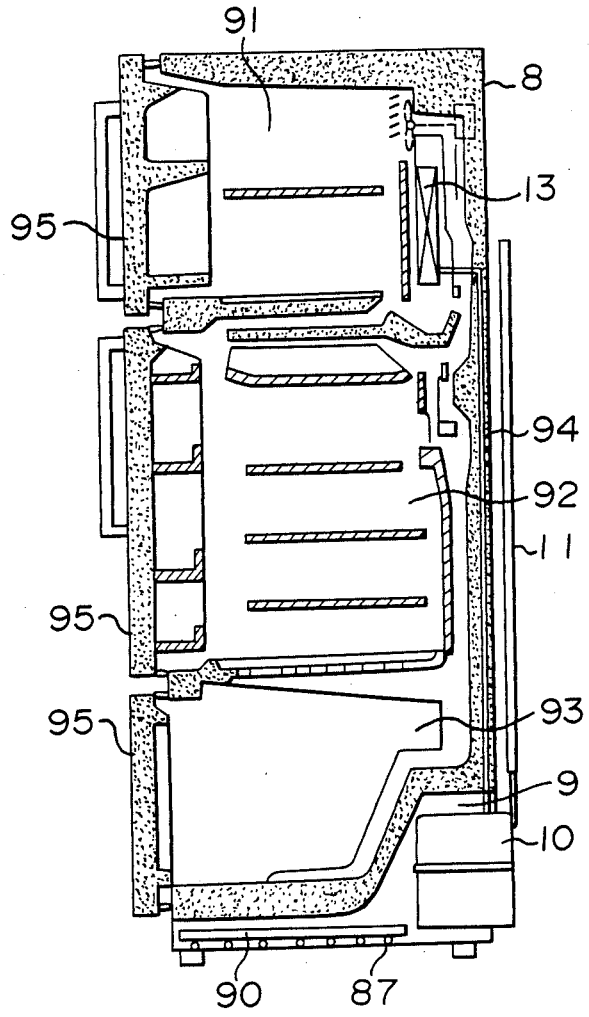
FIGURE 21 PRIOR ART
FIG. 21 is a vertical cross section showing the refrigerator as shown in FIG. 19.

FIG. 16 is the vertical section of a refrigerator to which the embodiments of the present invention can be applied. Only the differences between the refrigerator as shown in FIG. 16 and the conventional one as shown in FIG. 21 will be explained. In FIG. 16, reference numeral 96 designates a drain pan. Reference numeral 98 designates a drainage evaporation subcondenser. Reference numeral 97 designates a vegetable compartment. As can be seen from the comparison with the conventional refrigerator of FIG. 21, the refrigerator of FIG. 16 is characterized in that the condenser 11 is omitted from the rear portion. In addition, the drain pan 96 and the drainage evaporation subcondenser can be extended to the rear portion because it is not necessary to place the compressor in the machine compartment unlike the conventional refrigerator. As a result, fast refrigeration can be carried out without taking care of the drainage after the frost forming phenomenon. The depth of the vegetable compartment 97 can be remarkably increased.

What is claimed is:

1. A system comprising:

(a) a compressor;

(b) a refrigerator;

(c) an indoor heat exchanger;

(d) an outdoor heat exchanger;

(e) a first valve having a first, a second, a third, and a fourth connecting port;

(f) a second valve having a first, a second, a third, and a fourth connecting port;

(g) an expansion valve;

(h) a first path of fluid communication linking said compressor to said first connecting port of said first valve;

(i) a second path of fluid communication linking said second connecting port of said first valve to said outdoor heat exchanger;

(j) a third path of fluid communication linking said outdoor heat exchanger to said first connecting port of said second valve;

(k) a fourth path of fluid communication linking said second connecting port of said second valve to said expansion valve;

(l) a fifth path of fluid communication linking said expansion valve to said first connecting port of said second valve;

(m) a sixth path of fluid communication linking said fourth connecting port of said second valve to said indoor heat exchanger;

(n) a seventh path of fluid communication linking said expansion valve to said refrigerator;

(o) an eighth path of fluid communication linking said refrigerator to said compressor;

(p) a ninth path of fluid communication linking said third connecting port of said first valve to said compressor; and (q) a tenth path of fluid communication linking said fourth connecting port of said first valve to said indoor heat exchanger.

2. A system as recited in claim 1 wherein:

(a) said expansion valve is connected to a T-pipe joint;

(b) said fifth path of fluid communication is connected to said expansion valve via said T-pipe joint; and (c) said seventh path of fluid communication is connected to said expansion valve via said T-pipe joint.

3. A system as recited in claim 1 wherein a solenoid controlled valve is located in said ninth path of fluid communication.

4. A system as recited in claim 1 wherein a pressure pump is located in said eighth path of fluid communication.

5. A system as recited in claim 4 wherein a check valve is located in said eighth path of fluid communication between said pressure pump and said compressor.

6. A system as recited in claim 5 wherein said ninth path of fluid communication is connected to said eighth path of fluid communication between said check valve and said compressor.

7. A system as recited in claim 6 wherein a solenoid controlled valve is located in said ninth path of fluid communication.

8. A system as recited in claim 1 wherein:

(a) the compressor comprises a compressor with one intake port, a pressure pump, and a check valve and (b) the pressure pump and the check valve are arranged in the eighth path so that the check valve is positioned between:

(i) the joint point of the eighth path and the ninth path and (ii) the pressure pump, thereby preventing refrigerant from flowing back in to the pressure pump.

9. An air conditioning system with a refrigerator integrated, including:

(a) an air conditioning device having a first cycle comprising:

(i) a compressor for compressing a refrigerant to turn it into the gaseous refrigerant having high temperature and high pressure, (ii) a condenser for cooling the gaseous refrigerant to turn it into the liquid refrigerant having middle temperature and high pressure, (iii) a first expansion valve for giving adiabatic expansion to the liquid refrigerant to turn it into the vaporous liquid refrigerant having low temperature and low pressure, and (iv) a first evaporator for evaporating the vaporous liquid refrigerant to turn it into the gaseous refrigerant, and for returning the gaseous refrigerant to the compressor, and (b) a refrigerator having a second cycle comprising:

(i) the compressor, (ii) the condenser, (iii) a second expansion valve for giving adiabatic expansion to the liquid refrigerant received from the condenser thereby to turn it into the vaporous liquid refrigerant having low temperature and low pressure, (iv) a second evaporator for evaporating the vaporous liquid refrigerant received from the second expansion valve thereby to turn it into the gaseous refrigerant having low temperature and low pressure, and for returning the gaseous refrigerant to the compressor, (v) a switching circuit having its input end connected to an outdoor heat exchanger and an indoor heat exchanger, and having its output end connected to the first expansion valve so that the refrigerator can work regardless of whether the air conditioning device is under cooling mode or heating mode, and (vi) a pressure pump which is arranged between the second evaporator and the compressor.

* * * * *